US005119747A

United States Patent [19]

Nishiura et al.

[11] Patent Number: 5,119,747

[45] Date of Patent: Jun. 9, 1992

[54] CHAINING THREAD SEW IN DEVICE

[75] Inventors: Yukio Nishiura, Kawanishi; Yuzo Kawamoto, Suita, both of Japan

[73] Assignee: Pegasus Sewing Machine Mfg. Co., Ltd., Osaka, Japan

[21] Appl. No.: 620,027

[22] Filed: Nov. 30, 1990

Related U.S. Application Data

[60] Division of Ser. No. 563,946. Aug. 7, 1990, which is a continuation of Ser. No. 184,493, Apr. 21, 1988, abandoned.

[30] Foreign Application Priority Data

Sep. 19, 1986 [JP] Japan ..... 61-144225[U]
Apr. 30, 1987 [JP] Japan ..... 62-108358
Apr. 30, 1987 [JP] Japan ..... 62-108359

[51] Int. Cl.[5] ..... D05B 65/06

[52] U.S. Cl. ..... 112/288; 112/287; 112/DIG. 1

[58] Field of Search ..... 112/130, 253, 260, 262.1, 112/285-288, 294, DIG. 3, DIG. 1

[56] References Cited

U.S. PATENT DOCUMENTS 3,490,403 1/1970 Boucraut ..... 112/288
4,108,097 8/1978 Gross et al. ..... 112/287
4,149,478 4/1979 Sanvito et al. ..... 112/288 X
4,187,793 2/1980 Fietta et al. ..... 112/287 X
4,220,105 9/1980 Palacino ..... 112/288 X
4,303,030 12/1981 Palacino et al. ..... 112/286
4,332,209 6/1982 Gauch ..... 112/288 X
4,453,481 6/1984 Garnett et al. ..... 112/288
4,523,535 6/1985 Blackburn ..... 112/288

FOREIGN PATENT DOCUMENTS 2814965 11/1978 Fed. Rep. of Germany ..... 112/253
3621574 1/1987 Fed. Rep. of Germany ..... 112/288
2588576 4/1987 France ..... 112/253
1087600 10/1967 United Kingdom ..... 112/288

*Primary Examiner*—Werner H. Schroeder
*Assistant Examiner*—Ismael Izaguirre
*Attorney, Agent, or Firm*—Jones, Tullar & Cooper

[57] ABSTRACT

A chaining thread sew-in device for sewing a chaining thread produced consecutively in the seams of a preceding cloth and in the seams of a next cloth when forming seams by an overlock sewing machine. The free end of the chaining thread (Ch) cut off from the preceding cloth is inserted into an insertion hole (H) opening on a sewing machine working face (1a), and the inserted chaining thread (Ch) is pinched beneath the sewing machine working face (1a), so that the chaining thread to be sewn into the seams of the next cloth is set at specified position on the sewing machine working face (1a). The chaining thread set at a specified position is moved to a cutter (40) installed side of the machine by driving a sub-pinching plate (72, 272), and is cut off from the pinched part by this cutter (40).

8 Claims, 25 Drawing Sheets

CHAINING THREAD SEW IN DEVICE

This is a divisional of co-pending application Ser. No. 07/563,946 filed on Aug. 7, 1990, which is a continuation of application, Ser. No. 07/184,493, filed Apr. 21, 1988, now abandoned.

FIELD OF THE INVENTION

This invention relates to a chaining thread sew-in device attached to an overlock sewing machine for cutting a chaining thread produced consecutively in seams which are formed in a cloth by linking the edge of a cloth by the overlock sewing machine, by leaving a specified length from the machine side, and sewing in the chaining thread continued from the machine into the seams of the next cloth.

BACKGROUND OF THE INVENTION

A conventional chaining thread sew-in device attached to an overlock sewing machine for a chaining thread holder/cutter integrally comprising a knife and a pinching member made of elastic material disposed on a working face at an upstream side of the needle location, in which the operator brought the chaining thread created upon completion of sewing, together with the cloth, to the upstream side to press against the knife so as to cut by its cutting edge, the free end of the cut-off chaining thread pinched by the pinching member. The chaining thread left over at the machine side was held on the upper surface of the throat plate, and this chaining thread was sewn into the stitches of the next cloth, so that ravel of the stitches at the starting part could be prevented without any particular bar tacking process.

In such a chaining thread sew-in device, however, in order to cut the chaining thread consecutively produced from the cloth, the operator must move the cloth toward the upstream side of the needle location every time sewing of one cloth is over, which created a bottleneck with respect to improvement of job efficiency or automation of operation.

Accordingly, U.S. Pat. No. 4,149,478, it has been proposed to suck the chaining thread consecutively with the seams formed on a cloth into a suction tube behind the needle location, cut the chaining thread by the cutter provided in the opening of this tube by leaving a specified length from the machine side, move the free end of this chaining thread continuously from the machine side toward the front side of the needle location by air pressure, suck the free end of the thus transferred chaining thread by the suction part at the free end of the chaining thread, and operate the chaining thread pinching part disposed on the working face of the cloth plate so as to pinch the free end of the chaining thread.

In the conventional devices such as disclosed in U.S. Pat. No. 4,149,478, however, since the chaining thread pinching part and suction part of the free end of the chaining thread were disposed on the working face, this chaining thread pinching part disturbed the cloth feed, and job efficiency was often lowered.

Still, in the conventional devices, since the length of the chaining thread sewn into the seams of cloth was determined by the cutting position of the cutter disposed in the opening of the suction tube, it was difficult to change the length of the chaining thread to be sewn in depending on the products.

SUMMARY OF THE INVENTION

In light of the above background, it is a first object of this invention to provide a chaining thread sew-in device of an overlock sewing machine causing no disturbance to the insertion of cloth or cloth feed.

It is a second object of this invention to provide a chaining thread sew-in device of an overlock sewing machine capable of varying the length of the chaining thread to be sewn in the seams of a cloth.

The chaining thread sew-in device of this invention is designed to insert the free end of the chaining thread moved toward the upstream side of the needle location by air pressure into the insertion hole opened on the working face of the sewing machine, and pinch the inserted chaining thread beneath the working face of the sewing machine. Therefore, the pinching part of the chaining thread does not interfere with the insertion or feed of the cloth in which the chaining thread is sewn, and job efficiency is enhanced.

The chaining thread sew-in device of this invention comprises a pinching plate capable of moving so as to open an insertion hole in which the free end side of the chaining thread is transferred to the working face by air pressure, a form part of the working face of the sewing machine before the needle location with its upper surface, and a drive mechanism for driving the pinching plate, in which the chaining thread is inserted into the insertion hole opened in the sewing machine working face by air, and the pinching plate is moved by the drive mechanism to close the insertion hole, and the free end side of the chaining thread inserted in the insertion hole is pinched between the pinching plate and the pinching plane opposed to the pinching plate at the time of forming the insertion hole. Therefore, except when inserting the free end of the chaining thread, the insertion hole is not opened in the sewing machine working face, and the surface is identical with the usual sewing machine working face at the time of forming seams, etc. Besides, the device is simplified because it is not necessary to dispose the pinching plate and the pinching plane to pinch the chaining thread with this pinching plate additionally beneath the working face. Moreover, since the pinching part of the chaining thread is disposed consecutively to the sewing machine working face, insertion of the chaining thread into the pinching part by the chaining thread insertion means becomes secure.

Furthermore, the chaining thread sew-in device of this invention also comprises a sub-pinching plate capable of moving while pinching the chaining thread in cooperation with the pinching plate, as part of forming the pinching plane opposite to the pinching plate, a second drive mechanism for driving the sub-pinching plate, and a cutter disposed on the moving trajectory of the chaining thread pinched between both plates, in which the free end side of the chaining thread is pinched between the pinching plate and the sub-pinching plate, the sub-pinching plate is driven by the second driving mechanism, and the pinched chaining thread is separated from the pinching part by crossing with the cutter. Therefore, the length of the chaining thread sewn in between the pinching plate and the sub-pinching plate can be changed depending on the product.

In this invention, the chaining thread sew-in device may also comprise a chaining thread insertion hole opened in the cloth plate to form the sewing machine working face, a fixed plate fixed beneath this chaining thread insertion hole, a pinching plate which can be joined with or separated from the pinching surface of the fixed plate beneath the chaining thread insertion hole, a drive mechanism for joining or separating the fixed plate and pinching plane by driving the pinching plate, and a chaining thread insertion means for inserting the chaining thread among the chaining thread insertion hole, spaced fixed plate and pinching plate, in which the pinching plate is driven by the drive mechanism to be spaced from the fixed plate, the chaining thread is inserted between the pinching plate and fixed plate by the chaining thread insertion means, the pinching plate is brought in tight contact with the fixed plate, and the free end side of the chaining thread is pinched between these plates. Thus composed, the pinching plate and fixed plate are disposed beneath the sewing machine working face, so that the insertion of cloth or feed of cloth will not be disturbed.

DESCRIPTION OF THE PREFERRED EMBODIMENTS

Figure 1:
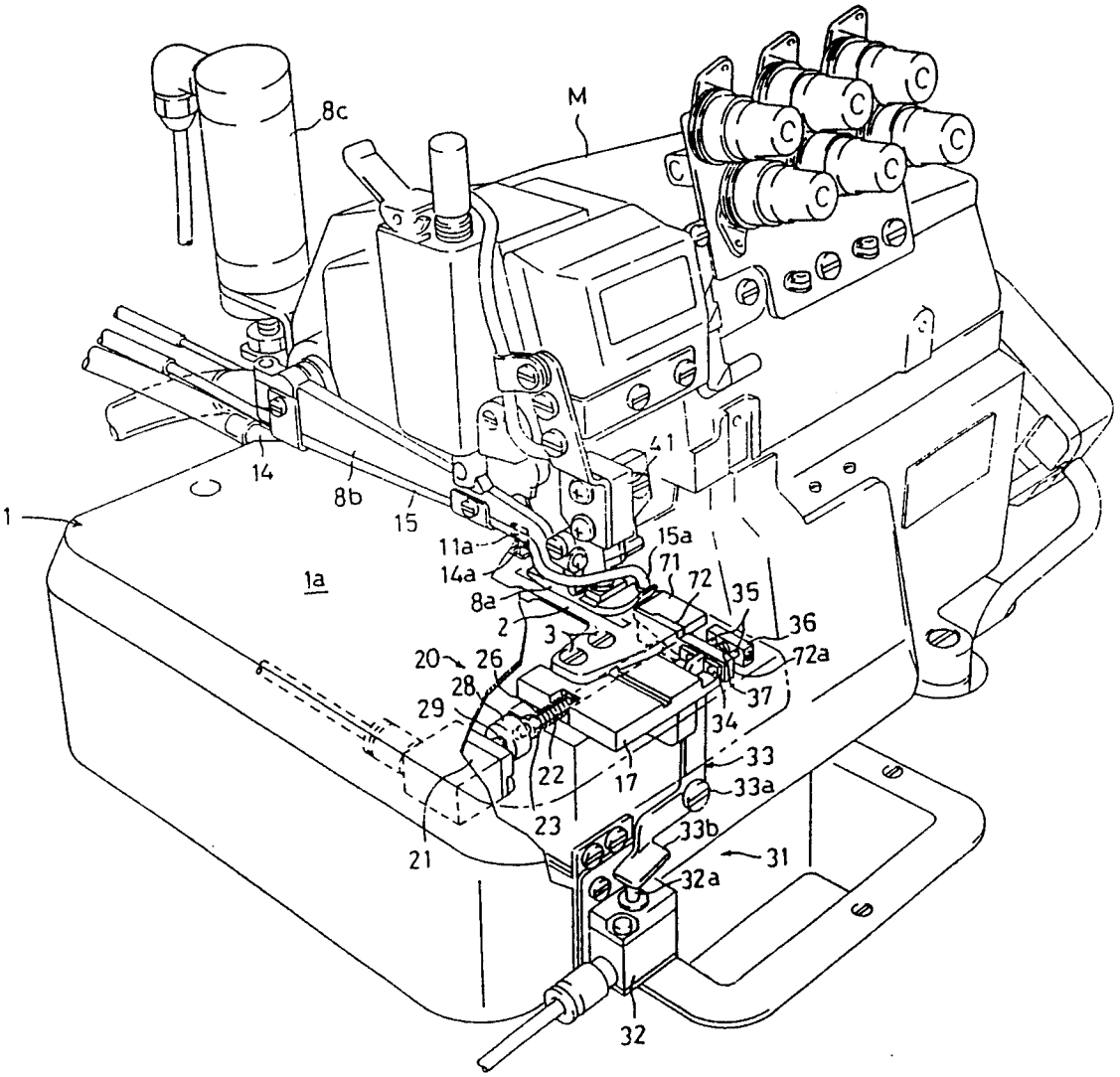
FIG. 1 is a partially cut-away perspective view showing a chaining thread sew-in device of an overlock sewing machine according to one of the embodiments of this invention.

Referring now to the drawings, this invention is further described below.

FIG. 1 is a partially cut-away perspective view showing a chaining thread sew-in device of an overlock sewing machine according to one of the embodiments of this invention, and FIG. 2A to FIG. 2F are schematic plan views, cutting away the cloth plate, showing the treating processes of the chaining thread by the device of FIG. 1.

Numeral 1 is a cloth plate of an overlock sewing machine, and a throat plate 2 is fitted into the position corresponding to the sewing needle on the working face 1*a*. of this cloth plate 1. This throat plate 2 is fixed to a bracket 17 mounted on the sewing machine main body M by means of bolts 3, and part of the working face 1*a* is formed on its upper surface. On the throat plate 2, a needle location 4 which penetrates through the working face la in the vertical direction is formed, and a tongue 5 stretching backward from the part adjoining with the needle location 4 (in the direction of arrow B in FIG. 2A to FIG. 2F) is also integrally disposed. In FIG. 2A to FIG. 2F, meanwhile, the X indicated by the dot-dash line is the sewing axis of this overlock sewing machine coinciding with the cloth feed direction passing through this needle location 4.

A recess 6 (FIG. 2A to FIG. 2F) is formed on the working face la which is at the tongue 5 disposed side with respect to the sewing axis X and at the upstream side (in the arrow A direction in FIG. 2A to FIG. 2F) from the needle location 4. One side of the recess 6 is a released side parallel to the sewing axis X. In this recess 6, a pinching plate 71 the upper surface of which is level with the working face 1*a* and forming part of the working face 1*a*, and a sub-pinching plate 72 are detachably inserted.

Figure 2A:
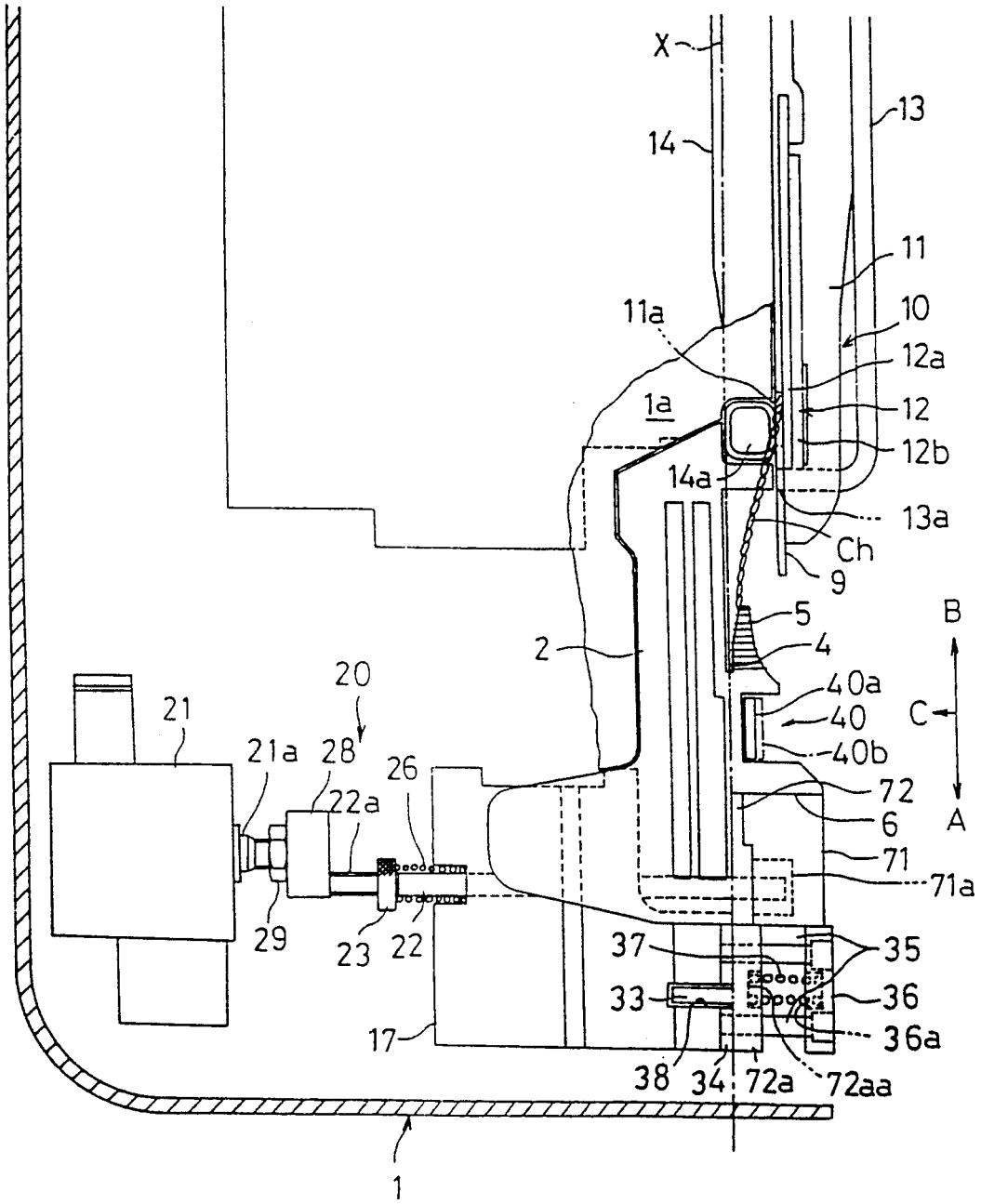
FIG. 2A to FIG. 2F are schematic plan views of essential parts, cutting away the cloth plate, showing the treating processes of the chaining thread by the device shown in FIG. 1.
Figure 2B:
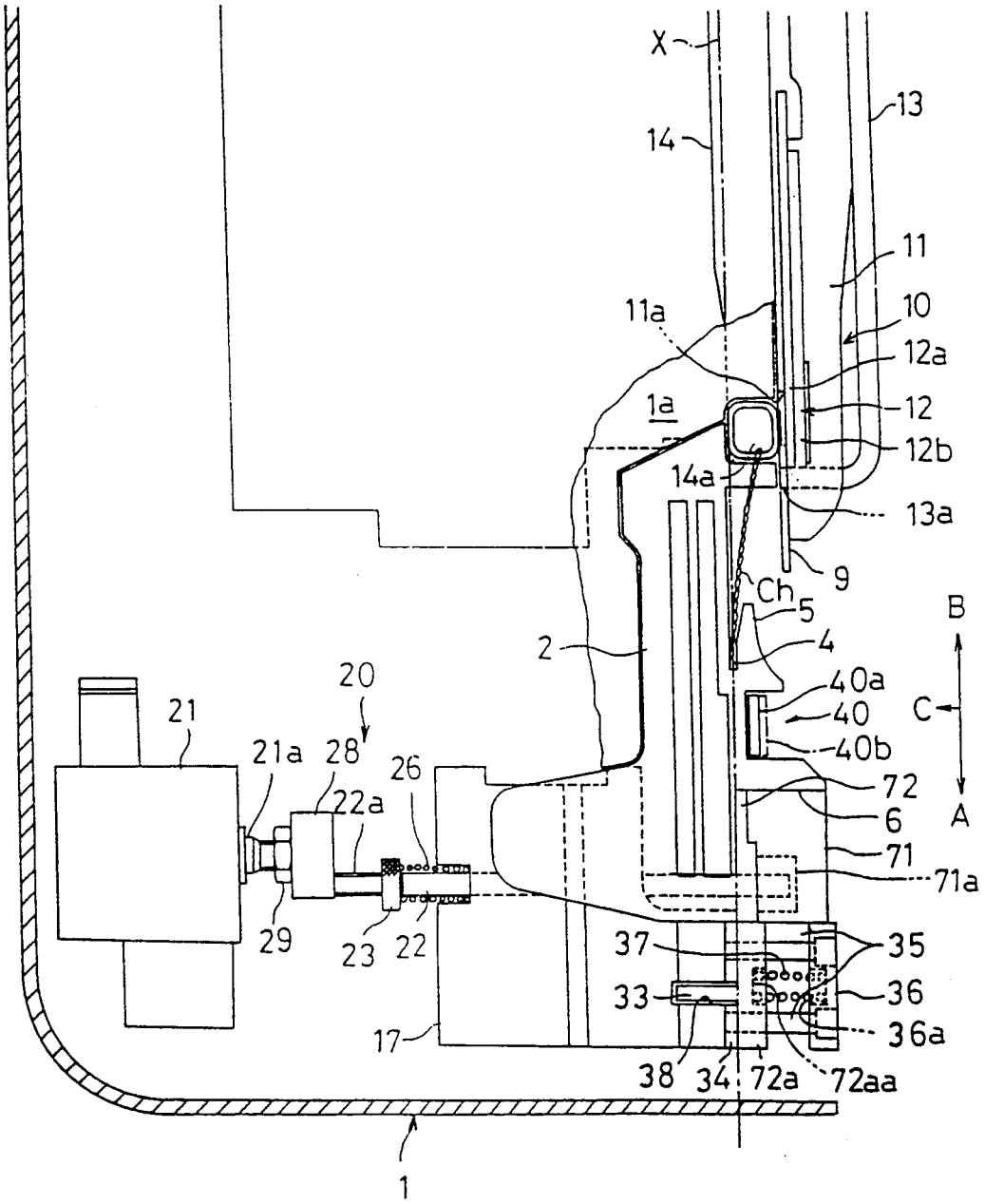

The pinching plate 71 is disposed at the released side of the recess 6, while the sub-pinching plate 72 is disposed at the bottom side of the recess 6. The pinching plate 71 and the sub-pinching plate 72 can contact each other. Besides, by the mechanism described below, the pinching plate 71 can be independently moved in the direction orthogonal to the sewing axis X, which causes an insertion hole H, of the chaining thread to open against the sub-pinching plate 72 as shown in FIG. 2D. On the other hand, when the sub-pinching plate 72 moves in the direction orthogonal to the sewing axis X, the pinching plate 71 also moves in cooperation.

What is represented by 8*a* in FIG. 1 is a presser foot for pinching the cloth, or the workpiece, against the throat plate 2, and this presser foot 8*a* is fitted to the front end of a presser stand 8*b* oscillatably pivoted on the rear side of the sewing machine main body M, and this presser stand 8*b* oscillates as an air cylinder 8*c* is operated, so that the presser foot 8*a* is moved up and down between the cloth pressing position and the release position.

Behind the tongue 5, as shown in FIG. 2A to FIG. 2F, a cloth guide 9 parallel to the sewing axis disposed at a specified interval from the sewing axis X is provided, standing upright from the working face 1*a*.

At the back side of the guide surface of this cloth guide 9, a chaining thread cutting part 10 is furnished. This chaining thread cutting part 10 has a suction passage 11 connected to an air suction source (not shown), using the rear side of the cloth guide 9 as part of its inner wall, and a suction hole 11*a* of this suction passage 11 is opened in the cloth guide 9 near the rear end of the throat plate 2. A cutter 12 is disposed in the suction hole 11*a*. The cutter 12 is composed of a fixed knife 12*a* with its tip fixed at the lower end of the suction hole 11*a*, and a movable knife 12*b* rotatably pivoted outside the suction passage and inserted into this suction hole 11*a* from above the suction passage 11. The movable knife 12*b* is driven by a member cooperating with the main shaft of the sewing machine, and its tip intersects with the tip of the fixed knife 12*a*. As thus composed, the chaining thread created by driving of the sewing machine is sucked by the suction hole 11*a*, and is cut by the fixed knife 12*a* and movable knife 12*b* so that a specified length may be always left over at the throat plate side. Incidentally, driving of the movable knife 12*b* is not always required to cooperate with the driving of the sewing machine. Instead, for example, by counting the stitch number per inch after the rear end of the cloth passes through the needle location 4, the sewing machine may be stopped when this count reaches a preset number, and may be actuated by a solenoid or the like; or the operator, confirming that a necessary length of chaining thread is produced, may drive by pedal operation or the like.

At the rear side of the cloth guide 9, parallel to the suction passage 11, an air pressure feed tube 13 connected with an air supply source (not shown) is disposed, and at the end of this air pressure feed tube 13, there is a nozzle 13*a* for blowing out the air in the direction orthogonal to the sewing axis X, with its open end linked to the cloth guide 9 at the downstream side of the suction hole 11*a*.

On the working face 1*a* adjoining with the suction hole 11*a* of the suction passage 11 and located at the sewing axis X and cloth guide 9, there is opened a suction port 14*a* of a suction tube 14 which is connected to the air suction source for attracting the chaining thread (not shown) and disposed by passing through the cloth plate 1. That is, the suction port 14*a* is disposed on the extension parallel to the sewing axis X stretched from the end of the tongue 5.

On the presser stand 8*b* is supported a blow pipe 15 which is connected to the air supply source (not shown) and has a nozzle 15*a* for blowing out air. This nozzle 15*a* is supported so as to blow air into the insertion hole H formed as the main pinching plate 71 is driven when the presser stand 8*b* pushes up at the presser foot 8*a* to the release position.

Below is described each drive mechanism for driving the pinching plate 71 and sub-pinching plate 72.

The pinching plate 71 is driven by actuating the first air cylinder 21 disposed in the cloth plate 1, which is described in further detail hereinafter.

The pinching plate 71 has a mounting piece 71*a* integrally formed on this lower surface. To this mounting piece 71*a* is fixed one end of a rod 22 which is oscillatably pivoted on the bracket 17 running in an orthogonal direction crossing the sewing axis X and the bracket 17 mounted on the sewing machine main body. At the protuberance of this rod 22 from the bracket 17, male threads 22*a* are spirally provided, and a spring stopper 23 is engaged with the male threads 22*a*. Between the spring stopper 23 and the bracket 17 is stretched a compression spring 26, and by the thrusting force of this compression spring 26, the pinching plate 71 mounted on the rod 22 is thrust in the direction (arrow C direction) contacting the sub-pinching plate 72. On the piston rod 21*a* of the first air cylinder 21, a rod pressing member 28 is affixed, and this rod pressing member 28 abuts against or approaches the end of the rod 22 when the piston rod 21*a* retreats and the pinching plate 71 contacts with the sub-pinching plate 72. Meanwhile, male threads are spirally provided on the piston rod 21*a*, and by adjusting a locking nut 29 engaged with these male threads 22, the position of the rod pressing member 28 may be adjusted in the forward or backward direction of the piston rod 21*a*. As the first air cylinder 21 stretches the piston rod 21*a*, the rod pressing member 28 is affixed at a position capable of pressing the rod 22 by overcoming the thrusting force of the compression spring 26.

That is, a first drive mechanism 20 for driving the pinching plate 71 is composed of the first air cylinder 21, rod 22, mounting piece 71*a*, spring stopper 23, compression spring 26, rod pressing member 28, and locking nut 29.

Next is explained the driving of the sub-pinching plate 72. The sub-pinching plate 72 is driven by a second air cylinder 32 disposed beneath the cloth plate 1. In more detail, an operating piece 72*a* extending downward toward the working face 1*a* of the nearer side (arrow A side) is integrally formed on the sub-pinching plate 72. When this operating piece 72*a* abuts against the throat plate 2 on the sewing axis X, it simultaneously abuts against the abutting member 34 integrally formed on the bracket 17. To this abutting member 34 is attached one end of a guide rod 35 extending in the direction to cross orthogonally with the sewing axis X, and penetrating through the operating piece 72*a*. The other end of the guide rod 35 is linked to a spring stopper stand 36. A compression spring 37 is stretched between the spring stopper recess 36a formed in the spring stopper stand 36 and the spring stopper recess 72*a* a formed in the operating piece 72*a*. The operating piece 72*a* is thrust to the abutting member 34 side by the thrusting force of the compression spring 37. On the other hand, a notch 38 opened in the face abutting against the operating piece 72*a* is formed in the abutting member 34 and the bracket 17 which is integral therewith, and the end of a rocker arm 33 for transmitting the operation of the second air cylinder 32 is inserted in this notch 38. The rocker arm 33 is formed in an L-shape, its corner 33*a* is rotatably pivoted, and the upper end of one side standing up from this corner 33*a* is inserted into the notch 38, as mentioned above. At the end of one side extending laterally from the corner 33*a* of this rocker arm 33, a rod receiver 33*b* is formed, and this rod receiver 33*b* abuts against the piston rod 32*a* of the second air cylinder 32 which advances and retreats in the vertical direction. Therefore, when the piston rod 32*a* is extended to push up the rod receiver 33*b*, the rocker arm 33 oscillates around the corner 33*a*, and the end inserted in the notch 38 projects from the abutting surface of the abutting member 34 and operating piece 72*a*, thereby pressing the operating piece 72*a* toward the spring stopper stand 36 side, overcoming the thrusting force of the compression spring 37. When the operating piece 72*a* is thus pressed, the sub-pinching plate 72 integrally formed with the operating piece 72*a* is shifted to the pinching plate 71 side in cooperation therewith. At this time, it is evident that the pinching plate 71 moves while resisting the thrusting force of the compression spring 26. Incidentally, when the piston rod 32*a* of the second air cylinder 32 is moved back, the end of the rocker arm 33 returns to be back in the notch 38, and the operating piece 72*a* is thrust by the compression spring 37 to abut against the abutting member, while the sub-pinching plate 72 abuts against the throat plate 2 on the sewing axis X at the same time. Thus, when the sub-pinching plate 72 is moved to abut against the throat plate 2 on the sewing axis X, the pinching plate 71 is also moved toward the sewing axis X side in cooperation with the sub-pinching plate 72 by the thrusting force of the compression spring 26. Therefore, when the second air cylinder 32 is operated, the pinching plate 71 and sub-pinching plate move in cooperation in the mutually contacting state.

That is, the second drive mechanism 31 is composed of the second air cylinder 32, rocker arm 33, abutting member 34, guide rod 35, spring stopper stand 36, and compression spring 37.

Between the tongue 5 and pinching plate 71, a cutter 40 comprising fixed knife 40*a* and movable knife 40*b* having cutting edges parallel to the sewing axis X is disposed. This cutter 40 is disposed on the moving trajectory of the chaining thread Ch held by the pinching plate 71 and sub-pinching plate 72 when they move in collaboration to the side remote from the sewing axis X, as shown in FIG. 2F. The movable knife 40*b* crosses the cutting edges by moving reciprocally around the rear side of the fixed knife 40*a* in synchronism with the driving of the sewing machine, so that the chaining thread Ch is cut off when crossing with the cutter as shown in FIG. 2F.

Numeral 41 is, meanwhile, a cloth end sensor for detecting the edge of a cloth.

The operation of thus composed chaining thread sew-in device is described below by referring also to the air pressure circuit diagram shown in FIG. 3.

In the first place, the chaining thread cutter 10 is operated to cut off the chaining thread connected with the cloth from the cloth. That is, as described below, when the sewing machine is driven, the air suction source 501 shown in FIG. 3 which is connected to the suction passage 11 is put in operation, and the chaining thread created consecutively at the seams of the cloth is automatically sucked into the suction hole 11*a* by feeding the cloth, and as the movable knife 12*b* is driven, it is separated from the cloth. FIG. 2A shows the state in which the chaining thread Ch separated from the cloth is sucked into the suction hole 11*a*. At this time, the chaining thread Ch is wound on the tongue 5 at its base end part.

Figure 4:
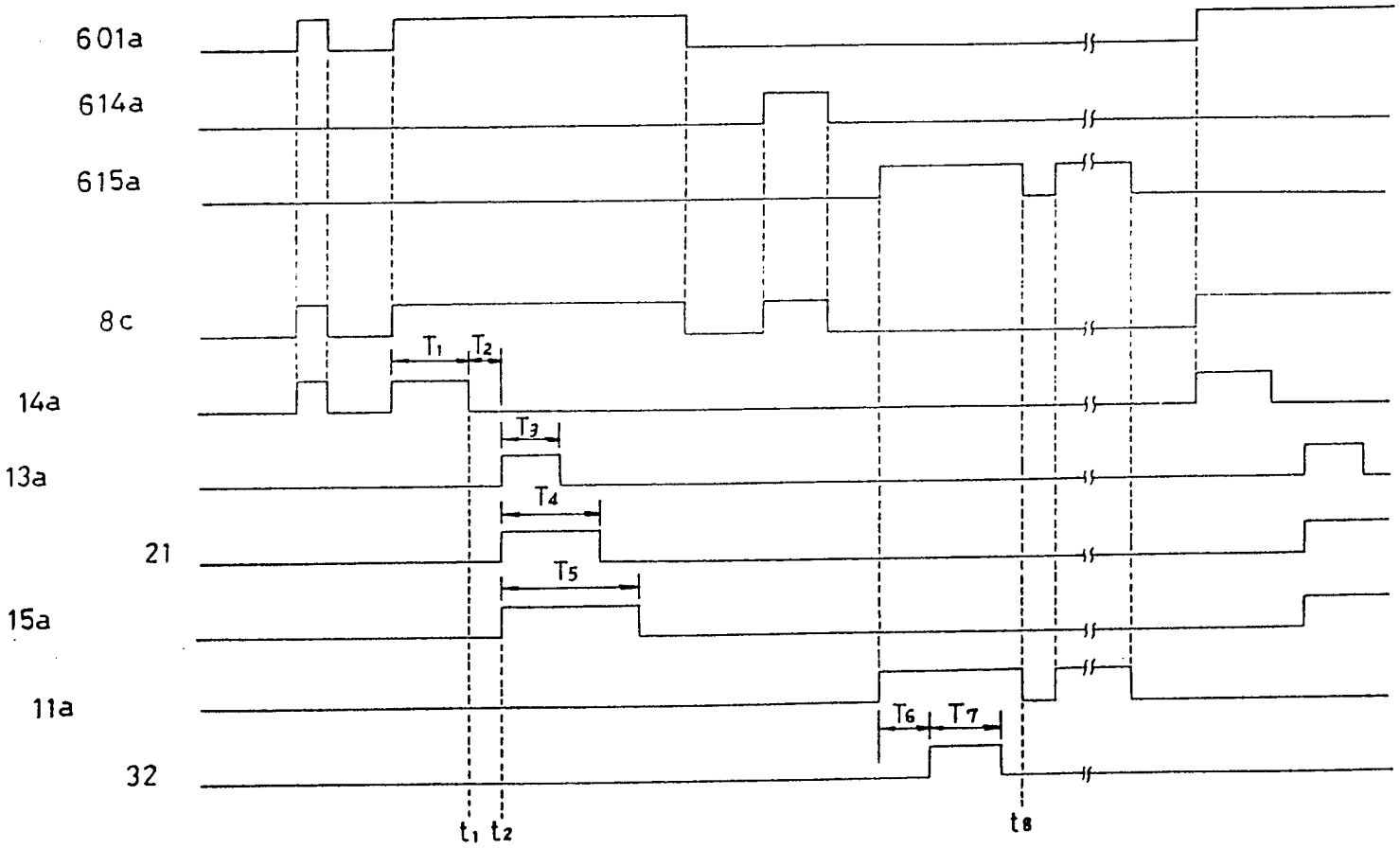
FIG. 4 is a timing chart showing the operation of the chaining thread sew-in device of FIG. 1 driven by the air pressure circuit of FIG. 3.

This operation is explained in further detail by referring also to the timing chart in FIG. 4.

When driving of the sewing machine is stopped in the state shown in FIG. 2A, suction by the air suction source 501 is also stopped. Here, by stepping on the pedal (not shown) of the sewing machine, the plunger 601A is pressed, and the changeover value 601 for pilot air supply is changed over, when the pilot air is supplied into the air supply line 701 from the pilot air supply source 502. The pilot air delivered into the air supply line 701 is delivered into the pressure receiving part of the pneumatic changeover valve 603 by way of the changeover valve 602*c* and air supply line 702 which make up a delay timer valve device 602 for setting the chaining thread suction time. As a result, this pneumatic changeover valve 603 is changed to the side to connect the suction tube 14 with the air suction source 503 for chaining thread suction, and the suction port 14*a* sucks the free end of the chaining thread Ch cut off by the chaining thread cutter 10 as shown in FIG. 2B. At this time, the base end side of the chaining thread Ch is pulled out of the tongue 5 and the whole chaining thread Ch is stretched at the same time.

The air delivered into the air supply route 701 is also sent into the pressure receiving part of the pneumatic changeover valve 605 through the shuttle valve 604, so that the pneumatic changeover valve 605 is changed to the side to connect the air cylinder 8*c* with the air supply source 505 for actuating the pump, and the air cylinder 8*c* raises the presser foot 8*a* as stated earlier.

Thus, when the plunger 601A of the changeover valve 601 for pilot air supply is pressed, as is clear from FIG. 4, suction from the suction port 14*a* and elevation of presser foot 8*c* are started simultaneously.

The delay timer valve device 602 is composed of a series connection of flow control valve 602*a*, air tank 602*b*, and said changeover valve 602*c*. The air tank 602*b* is designed to release the air to deliver into the pressure receiving part of the changeover valve 602*c* when the air volume inside reaches a specified level. Therefore, by adjusting the air flow per unit time to be delivered into the air tank 602*b* by means of the flow control valve 602*a* to set the time to reach the specified air volume in the air tank 602*b*, the changeover valve 602*c* is changed over in a specified time after the air is supplied into the air supply line 701, and supply of pilot air into the air supply line 702 is stopped. When the supply of pilot air into the air supply line 702 is stopped, the pneumatic changeover valve 602 is switched over to the side to cut off the connection between the suction tube 14 and air suction source for chaining thread suction 503, so that suction from the suction port 14*a* is stopped. That is, the suction time T1 of the suction port 14*a* shown in FIG. 4 is determined by adjusting the flow control valve 602*a*. Besides, as also shown in FIG. 4, when the pressure on the plunger 601*a* by the pilot air supply changeover valve 601 is released before the termination of suction time T1, the presser foot 8*b* is lowered on the spot, and the suction from the suction port 14*a* is stopped, too.

Numeral 606 denotes a differential area double pilot valve, and of the pressure bearing parts of this differential area double pilot valve 606, the first pressure bearing part 606*a* having the larger cylinder diameter is connected with the air supply line 702, while the second pressure bearing part 606*b* with smaller cylinder diameter is connected with air supply line 701. This differential area double pilot valve 606 opens and closes the communication between the air supply line 701 and the air supply route 703 connected to a flow control valve 607*a* which is described below. That is, while the pilot air supplied into the air supply line 701 is being sent into the air supply route 702 through the changeover valve 602*c*, this differential area double pilot valve 606 is located at the side to cut off the communication between the air supply line 701 and another air supply line 703, and when the changeover valve 602*c* is changed over and pilot air is no longer sent into the air supply line 702, the pilot air is fed into the second pressure bearing part 606*b*, thereby changing over to the side to communicate between the air supply line 701 and air supply route 703. Therefore, this differential air double pilot valve 606 supplies pilot air into the air supply line 703 when the suction of the suction port 14*a* is stopped, that is, time $t_1$ (see FIG. 4).

The delay timer valve device 607 for pinching start time setting is composed similar to delay timer valve device 602, and by adjusting the flow control valve 607*a*, the time to send air into the pressure bearing part of the changeover valve 607*c* from the air tank 607*b* can be determined. Therefore, at a specified time T2 after the pilot air is supplied into the air supply route 703, the changeover valve 607*c* is changed over, and the pilot air supply source 507 for pinching operation is connected to an air supply line 704.

This air supply line 704 is connected to ports of flow control valves 608*a*, 609*a*, 610*a*, and changeover valves 608*c*, 609*c*, 610*c* of delay timer valve device 608 for setting the air pressure feed time for moving the chaining thread, a delay timer valve device 609 for setting the insertion hole opening time, and a delay timer valve device 610 for setting the blow time. These delay timer valve devices 608, 609, 610 are respectively connected in series to flow control valves 608*a*, 609*a*, 610*a*, air tanks 608*b*, 609*b*, 610*b*, and changeover valves 608*c*, 609*c*, 610*c*, and by adjusting the flow control valves 608*a*, 609*a*, 610*a*, the time from supply of air into the air supply line 703 till release of air from the air tanks 608*b*, 609*b*, 610*c* is determined. The changeover valves 608*c*, 609*c*, 610*c* are located at the position to connect the air supply line 704 to the air supply lines 705, 706, 707, and when air is released from the air tanks 608*b*, 609*b*, 610*b*, they are changed over to the side to disconnect between the air supply line 704 and the air supply lines 705, 706, 707. These air supply lines 705, 706, 717 are connected to the pressure bearing parts of the pneumatic changeover valves 611, 612, 613. The pneumatic changeover valve 711 is, when air is supplied into the air supply line 705, changed over to the side to connect the driving air supply source 508 to the air pressure feed tube 13 mentioned above, while the pneumatic changeover valve 612 is, when air is supplied into the air supply line 706, changed over to connect the driving air source 509 to the first air cylinder 21, whereas the pneumatic changeover valve 613 is, when air is supplied into the air supply line 707, changed over to the side to connect the driving air supply source 510 to the blow pipe 15.

Thus, as the air is supplied from the driving air supply sources 508, 509, 510, the air is blown out from the nozzle 13*a* of the air pressure feed tube 13, and the first air cylinder 21 is actuated to extend the piston rod 21*a*, and the air is also blown out from the nozzle 15*a* of the blow pipe 15. Therefore, blowing of air from the nozzles 13*a*, 15*a* and extending of piston rod 21*a* are started simultaneously at $t_2$ as shown in FIG. 4, and as clear from the description hereabove, the air blowing time T3 from the nozzle 13*a*, the piston rod 21*a* driven time T4 to the extending side, and the air blowing time T5 from the nozzle 15*a* are set by the adjustment of the flow control valves 608*a*, 609*a*, 610*a*. Meanwhile, as shown in FIG. 4, these time durations T3, T4, T5 are set in the relation of $T3<T4<T5$.

Figure 2C:
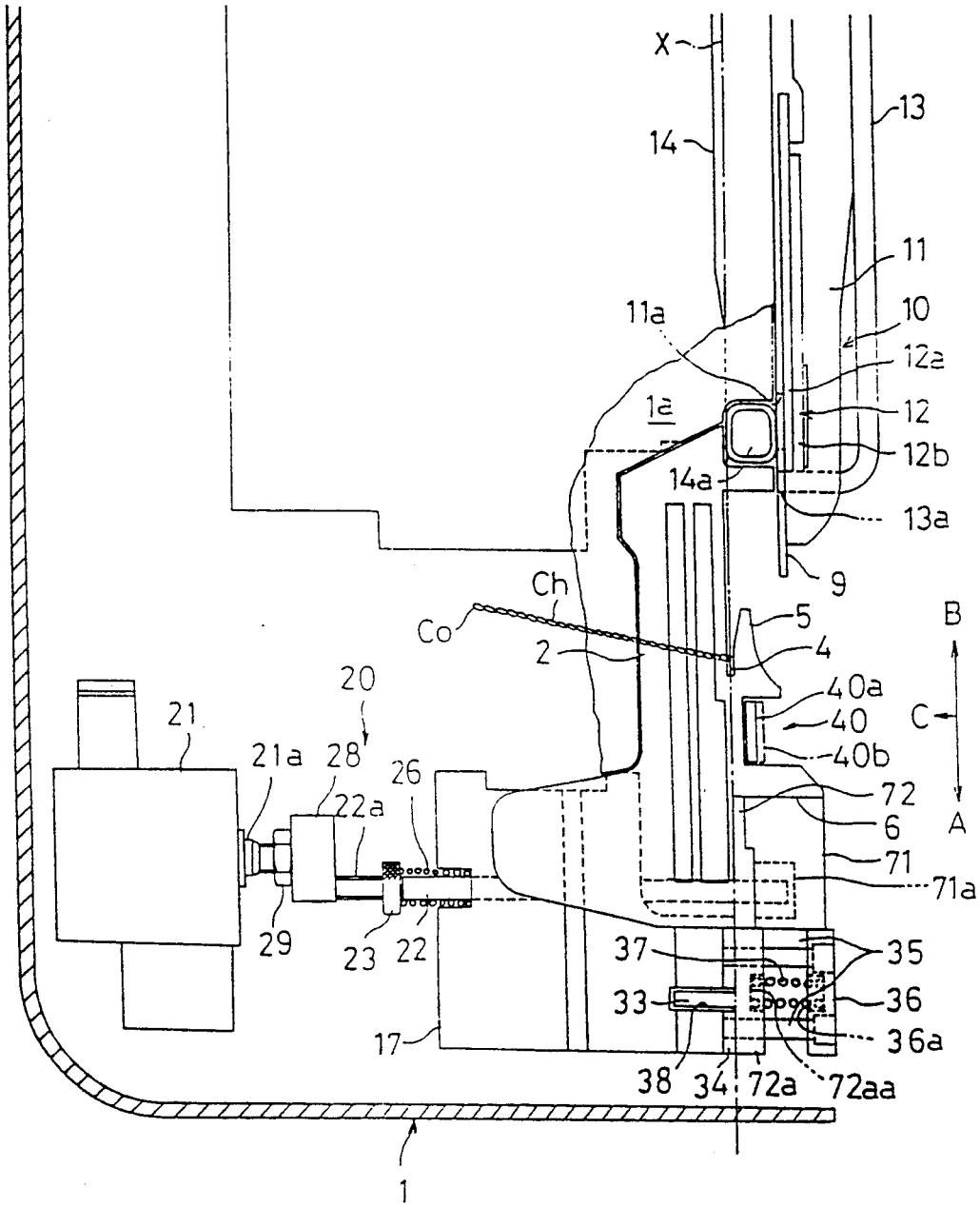
Figure 2D:
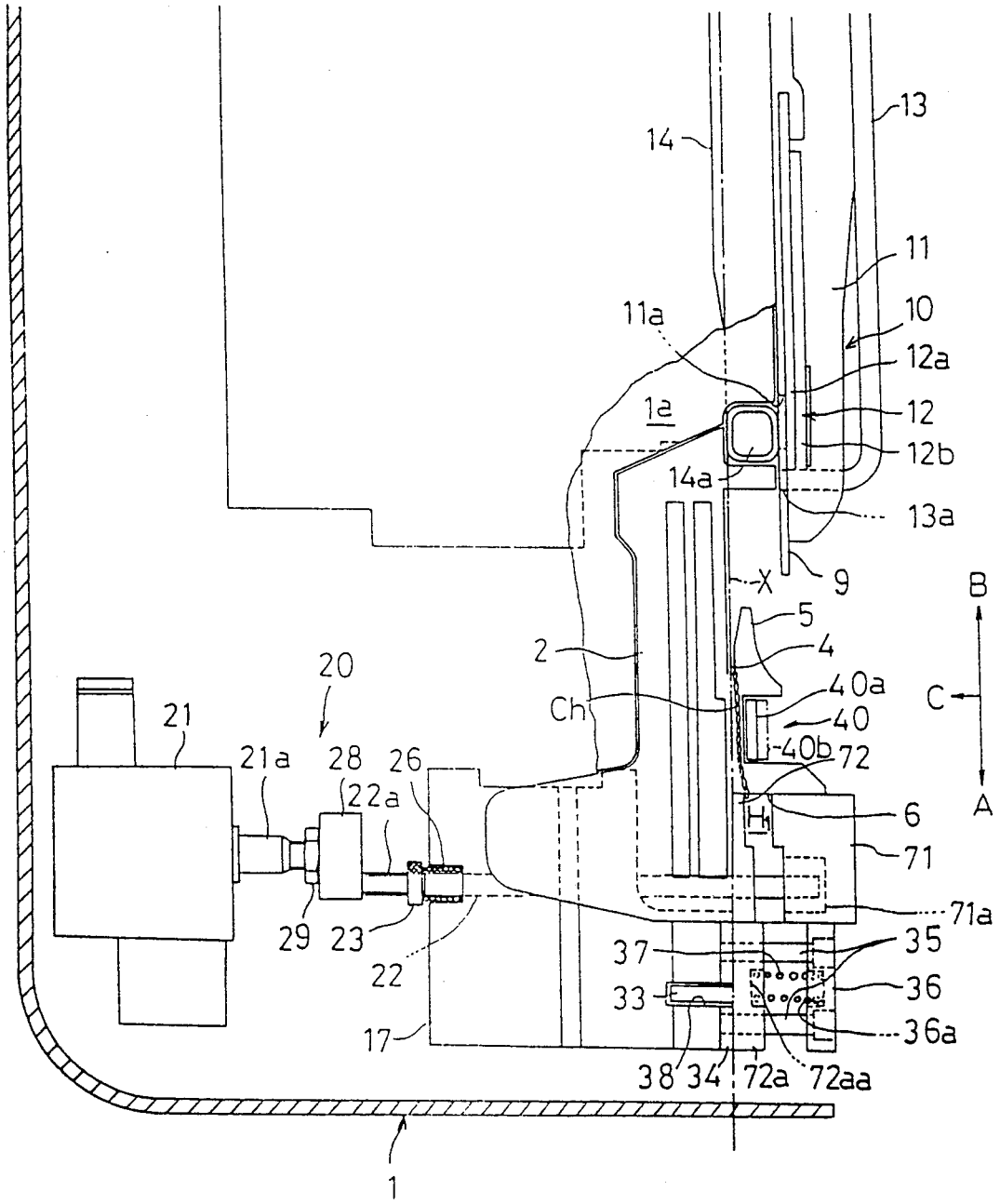

When air is blown out from nozzle 13*a*, as shown in FIG. 2C, the chaining thread Ch rotates about the needle location 4, and the free end Co of this chaining thread Ch is moved to the sewing machine front side. Thus, while the free end Co of the chaining thread Ch is moving, the piston rod 21*a* of the first air cylinder 21 is extended, and the pinching plate 71 moves, so that the chaining thread insertion hole H is formed at the machine side as shown in FIG. 2D, thereby causing the chaining thread Ch to be sucked into this insertion hole by the air blown out of the nozzle 15*a*. As stated above, the air blowing time T5 from the nozzle 15*a* is set longer than the driving time T4 of the first air cylinder because a sufficient time is required after disconnection of the driving air supply source 509 and the first air cylinder 21 until closure of the insertion hole H by withdrawal of the piston rod 21*a*, and in this period, by blowing air from the nozzle 15*a*, as shown in FIG. 2E, the chaining thread Ch is held taut between the pinching plate 71 and sub-pinching plate 72.

Figure 2E:
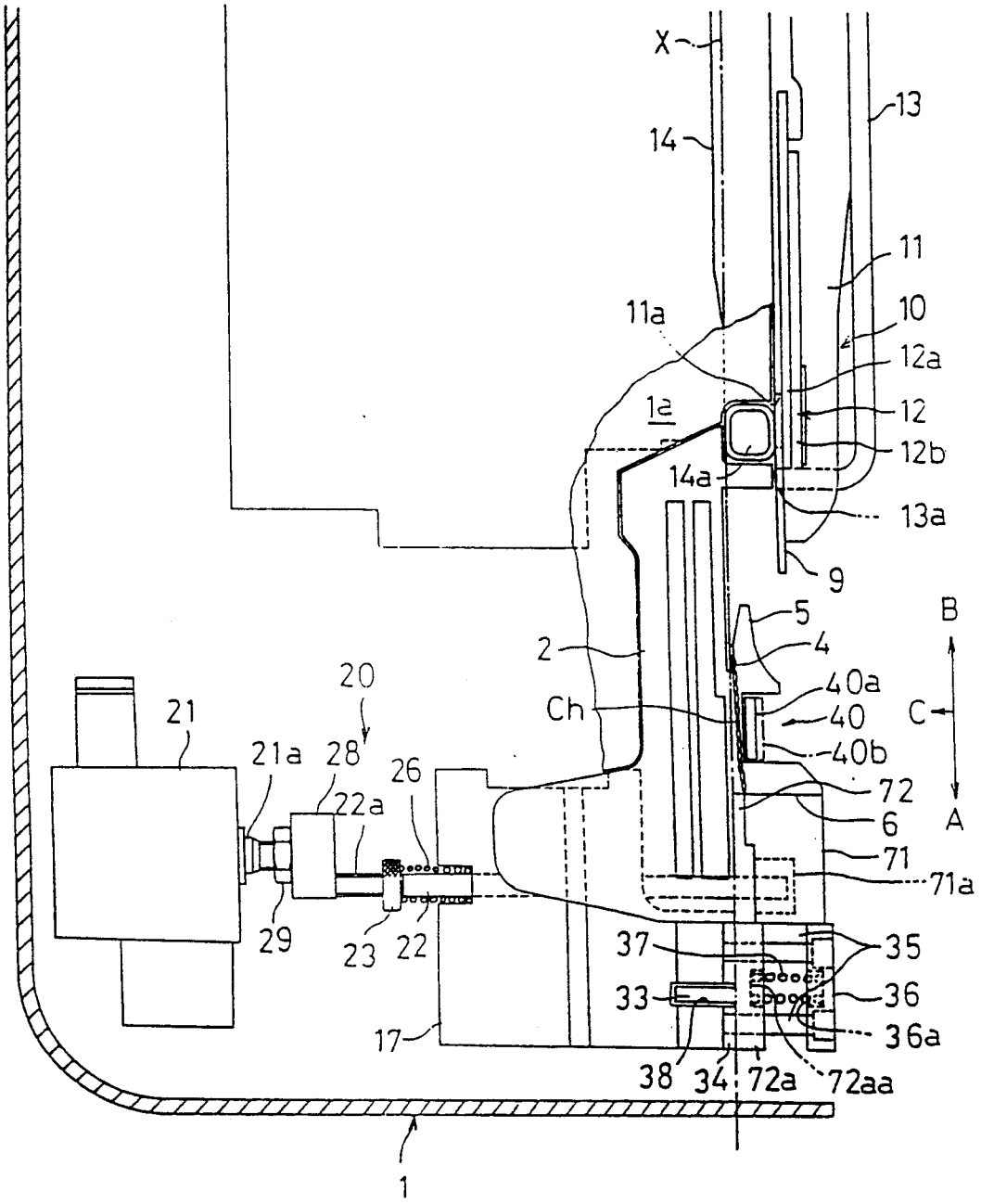
Figure 2F:
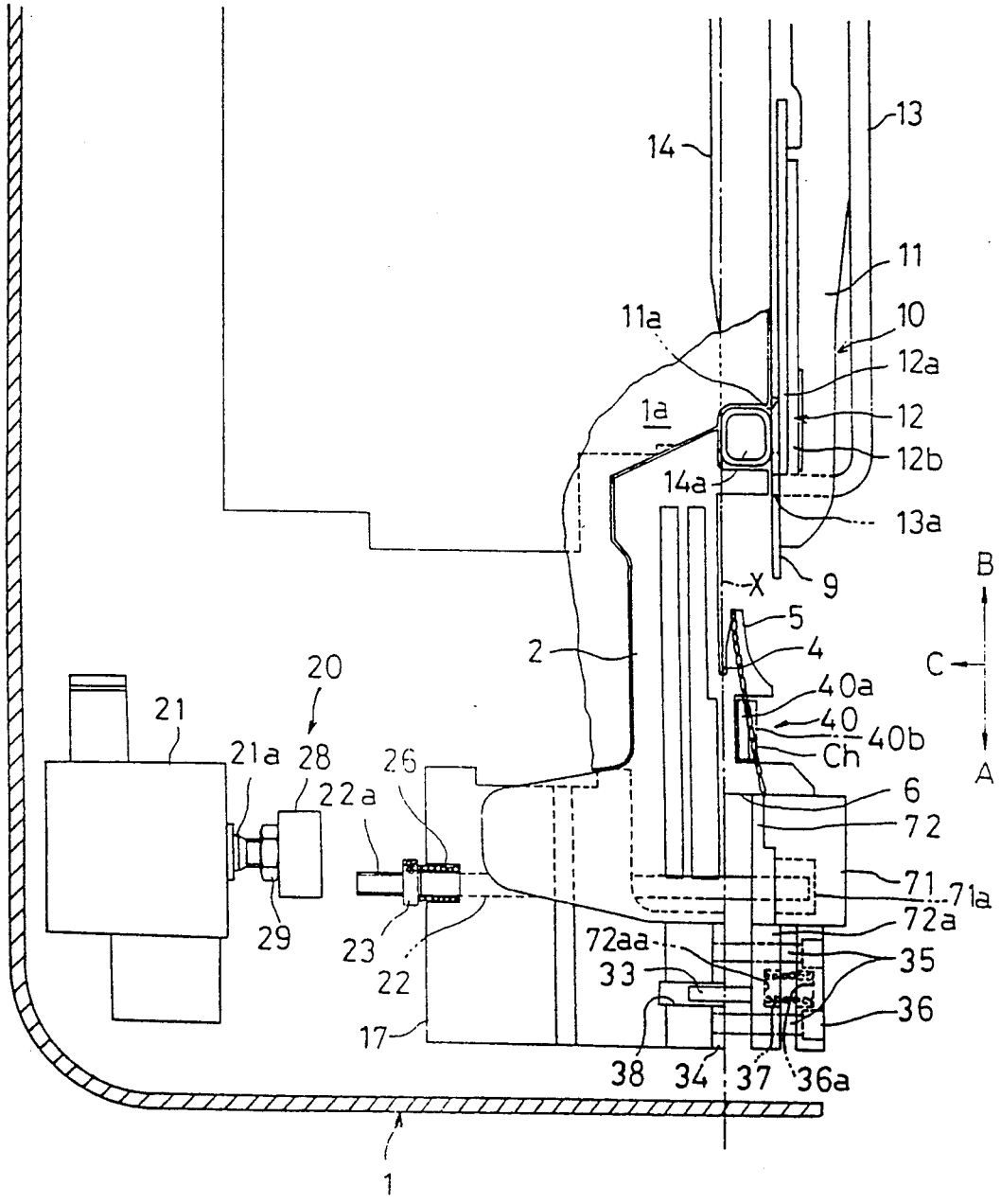

In this way, after the chaining thread Ch is pinched as shown in FIG. 2E, when the pressure to the plunger 601A of the changeover valve 601 for pilot air supply is released by pedal operation or the like, the air which has been delivered into the pressure bearing part of the pneumatic changeover valve 605 through the shuttle valve 604 is cut off, and the pneumatic changeover valve 605 returns to the side to disconnect the air supply source 505 for operating the pump and the air cylinder 8*c*, so that the presser foot 8*a* descends to the cloth holding position on the throat plate 2. Besides, by the release of the pressure to this plunger 601*a*, the changeover valve 602*c* returns to the initial state, and the changeover valve 607*c* also returns to the initial state, thereby disconnecting the pilot air supply source 507 for pinching action and the air supply line 704. As a result of stopping the supply of air to the air supply line 704, the changeover valves 608*c*, 609*c*, 610*c* also return to the initial state.

Then, by operating the pedal for raising the presser foot of the sewing machine, the plunger 614*a* of the changeover valve 614 for pilot air supply is pressed, and the pilot air supply source 511 and air supply route 701′ are connected. The air supplied into this air supply line 701′ is supplied into the pressure bearing part of the pneumatic changeover valve 605 through the shuttle valve 604, and the pneumatic changeover valve 605 is changed again to the side to connect the air supply source 505 for operating the pump and the air cylinder 8*c*, and the presser foot 8*a* is raised to the release position. In this state, after inserting a cloth (not shown), when the pressure to the operating part 614A is released, the connection of the pilot air supply source 511 and air supply line 701′ is cut off, and the pneumatic changeover valve 605 returns to the initial state, and the air in the air cylinder 8*c* is forced out, and the presser foot 8*a* is lowered, thereby pinching the cloth together with the throat plate 2.

Thus, after pinching the cloth between the presser foot 8*a* and throat plate 2, the sewing machine is driven, and seams are formed on the edge of the cloth. Numeral 615 is a changeover valve for supplying pilot air disposed in order to press the plunger 615*a* when the pedal is pushed forward to drive the sewing machine, and when the plunger 615*a* is pressed, it is changed to the position to connect the pilot air supply source 512 and the air supply line 708. This air supply route 708 is connected to the pressure bearing part of the pneumatic changeover valve 616 and one of the inlets of the shuttle valve 617.

The pneumatic changeover valve 616 is, when air is sent into the changeover operation part, changed to the side to connect the air suction source 501 and suction passage 11. In this way, when the sewing machine is driven, the air suction source 501 and suction passage 11 are connected at the same time so that the air is sucked in from the suction hole 11*a*. Accordingly, the length of chaining thread produced in the length to reach the suction hole 11*a* is always sucked into this suction hole 11*a*, and is cut off by the cutter 12.

On the other hand, the air delivered in from the air supply line 708 through the shuttle valve 617 is sent into the pressure bearing part of the pneumatic changeover valve 618, and the pneumatic changeover valve 618 is changed to the side to connect the pilot air supply source 513 and the air supply line 709.

The air supply line 709 is connected to the ports of the flow control valve 619*a* and changeover valve 619*c* of the delay timer valve device 619 for setting the cutting start time, and is also connected to the port of the pneumatic changeover valve 621.

At the pressure bearing part of the pneumatic changeover valve 621, the air supply route 707 is connected, and while air is not delivered into this air supply line 707, that is, usually, the pneumatic changeover valve 621 communicates the air supply line 709 with the air passage 710 connected to one of the inlets of the shuttle valve 617. Therefore, once the pneumatic changeover valve 618 is changed over, and the pilot air supply source 513 and the air supply line 709 are connected with each other, if for example, the driving of the sewing machine is stopped and air is not sent into the pressure bearing part of the pneumatic changeover valve 618 from the air supply line 708, the air sent out from the air supply source 513 is sent into the pressure bearing part of the pneumatic changeover valve 618 through the pneumatic changeover valve 612, shuttle valve 617, etc., so that the air is continuously fed into the air supply line 709 from the pilot air supply source as far as the connection of air supply source 709 and air passage 709 is not cut off by changing over the pneumatic changeover valve 621.

When air is delivered into the air supply line 709 in this way, the delay timer valve device 619 changes over the changeover valve 619*c* to the side to connect the air supply line 709 and the air supply line 711 after specified time T6 since the air is sent into the air supply line 709 by setting the air release time of the air tank 619*b* by adjusting the flow control valve 619*a*. This supply line 711 is connected to the air supply line 712 which is connected to the pressure bearing part of the pneumatic changeover valve 622 through the usual changeover valve 620*c* not receiving pressure in the pressure bearing part. The changeover valve 620*c* is to compose part of the delay timer valve 620 for setting the cutting end time, and this delay timer valve device 620 is composed of flow control valve 620*a*, air tank 620*b*, and the changeover valve 620*c*, and the air supply line 711 is connected to the flow control valve 620*a*. Therefore, by adjusting the flow control valve 620*a*, said changeover valve 620*c* is changes to the side to disconnect the air supply line 711 and air supply line 712, in specified time T7 after air is supplied into the air supply line 711, as being pressed by the air released from the air tank 620*b*.

The pneumatic changeover valve 622 is changed to the side to connect the driving air supply source 514 and the second air cylinder 32 while air is sent into the air supply line 721, that is, at specified time T7 from changeover of the changeover valve 619*c* by the air released from the air tank 619*b* until the changeover valve 620*c* is changed over by the air released from the air tank 620*b*. In consequence, for the specified time T7, the piston rod 32*a* of the second air cylinder 32 pushes upward the rod receptacle 33*b* of the rocker arm 33, and by this pressure, the rocker arm 33 oscillates around the corner 33*a*. This oscillation causes the front end part above the rocker arm 33 to press the operating piece 72*a* integrally formed on the sub-pinching plate 72 against the thrusting force of the compression spring 26 through the compression spring 37 stretched between this operating piece 72*a* and spring stopper stand 36 and the pinching plate 71 toward the sub-pinching plate side, so that the pinching plate 71 and sub-pinching plate 72 are moved to the side to bring the chaining thread Ch in contact with the cutter 40 while pinching the chaining thread Ch as shown in FIG. 2F. Thus, by this movement, when the chaining thread Ch crosses over the cutter 40 and is inserted between the fixed knife 40*a* and movable knife 40*b*, the movable knife 40*b* is driven in synchronism with the driving of the sewing machine, and the chaining thread to be sewn into the cloth seams is cut off from the pinched part between the pinching plate 71 and sub-pinching plate 72.

As evident from the description of operation hereabove, the length of the chaining thread to be sewn into the cloth can be varied by the timing to move the pinching plate 71 and sub-pinching plate in cooperation. That is, reversely speaking, by adjusting the flow control valve 619*a* of the delay timer valve device 619 to vary the specified time T6 from the driving of the sewing machine until operation of the second air cylinder 32, the length of the chaining thread to be sewn into the cloth can be selected.

As mentioned above, air is continuously fed into the air supply line 709 from the pilot air supply source 513 as far as the connection of the air supply line 709 and air supply line 710 is not cut off by changing over the pneumatic changeover valve 621, and this pneumatic changeover valve 621 is changed over only when air is delivered into the air supply line 707 for connecting the blow pipe 15 and driving air supply source 510 by a series of operations started by pressing the plunger 601*a* of the changeover valve 601 for pilot air supply. Therefore, as far as air is not delivered into the air supply line 707, if the sewing machine is driven again after once stopping its driving, the secondary air cylinder 32 would not be driven. Thus, by disposing a circuit composed of shuttle valve 617, pneumatic changeover valve 618, pilot air supply source 513, pneumatic changeover valve 621 and air passage 710 between the air supply lines 708 and 709, if the driving of the sewing machine is once stopped at the corner of a cloth or else, the sub-pinching plate 72 will not move thereafter unnecessarily.

It is hence possible to cut off the chaining thread consecutive with the seams at the terminal end of a previous cloth from this cloth, and sew it into the seams formed on the next cloth by a specified length.

Figure 3:
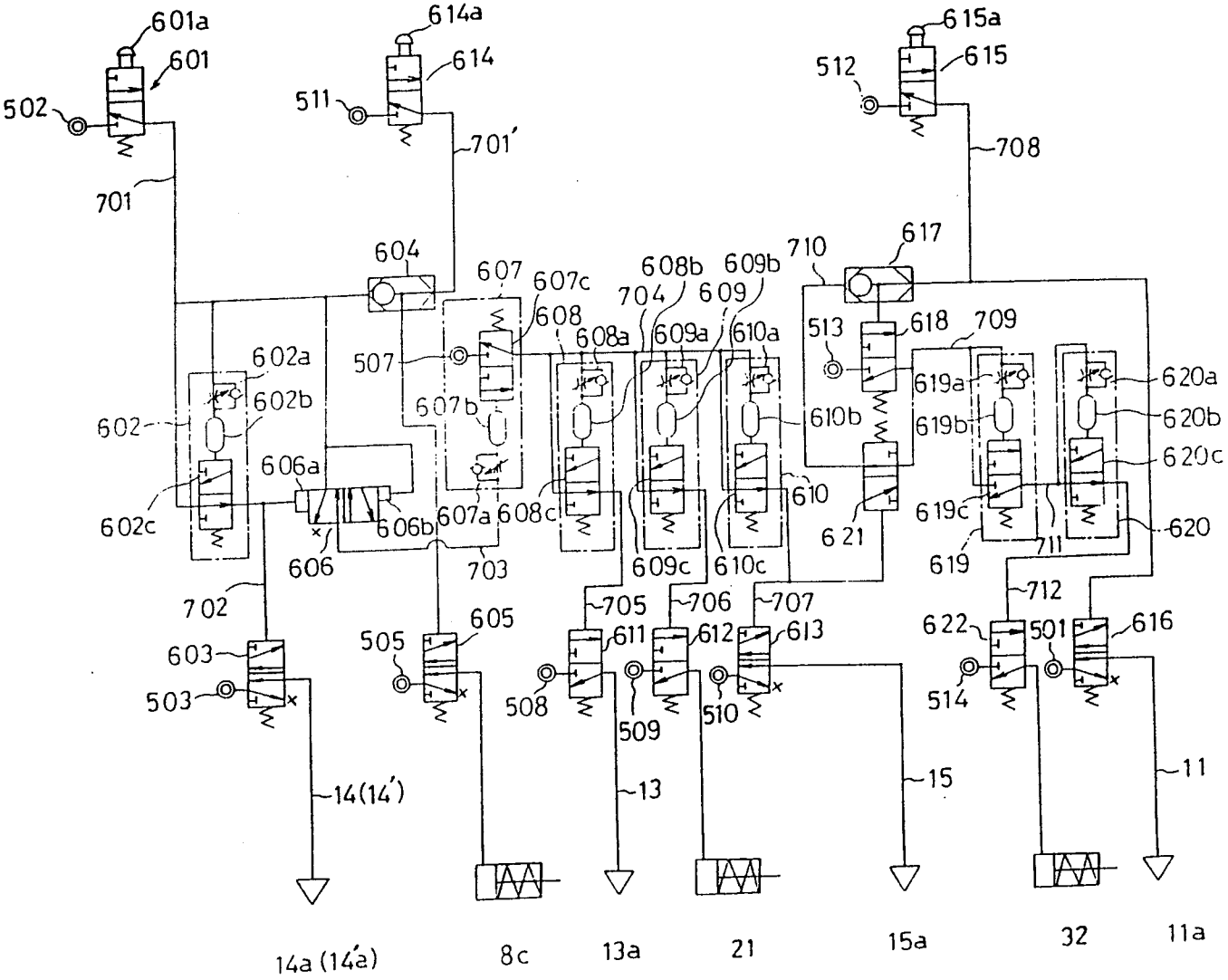
FIG. 3 is an air pressure circuit for driving the device of FIG. 1.
Figure 5:
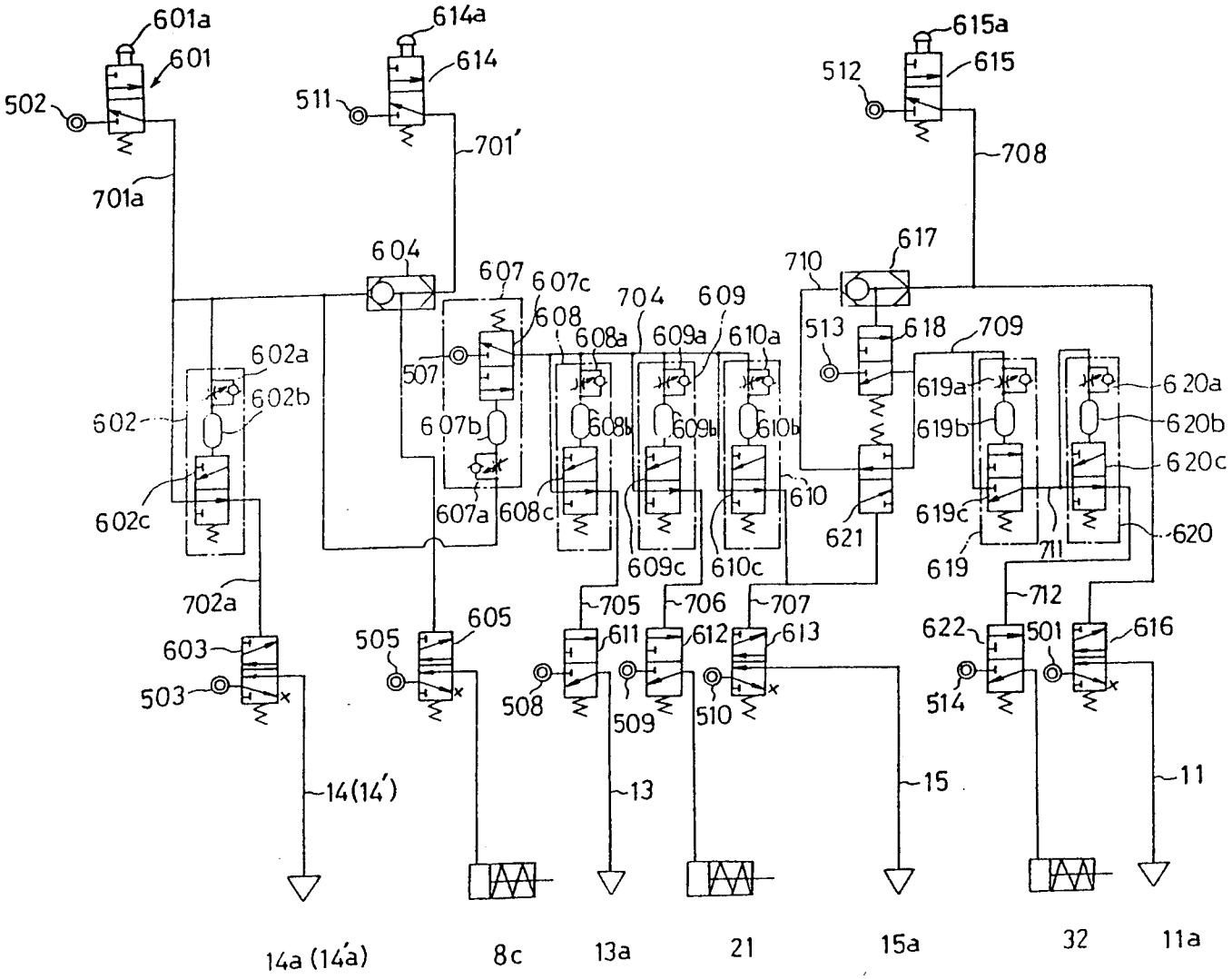
FIG. 5 is a diagram showing a modified example of the air pressure circuit.

In operating the chaining thread sew-in device of the embodiment shown in FIG. 1 and FIG. 2A to FIG. 2F, it may be also possible to compose by removing the differential area double pilot valve 606 from the pneumatic circuit shown in FIG. 3, connecting an air supply line 701*a*, in place of the air supply line 701 in FIG. 4 being linked with the changeover valve 601 for pilot air supply, as shown in FIG. 5, directly to a flow control valve 607*a* of the delay timer valve device 607 for setting the pinching start time, and connecting the air supply line 702*a* to be linked to the changeover valve 602*c* only to the pressure bearing part of the pneumatic changeover valve 603. (In FIG. 5, the parts identical with the components in FIG. 3 are identified with same code numbers.) In the case of this pneumatic circuit shown in FIG. 5, the air supply line 701*a* is connected to both flow control valves 607*a*, 602*a* of the delay timer valve device 607 and delay timer valve 602 for setting the chaining thread suction time. Therefore, as shown in FIG. 4, in order to start air blowing from the nozzles 13a, 15a and operation of the first air cylinder 21 in specified time T2 after suction time T1 from the suction port 14a, the flow control valve 607a of the delay timer valve device 607 must be adjusted so as to change the changeover valve 607c to the side to connect the air supply line 701a and 704 in T1+T2 after air is delivered into said flow control valve 607a. Therefore, in the pneumatic circuit shown in FIG. 5, when the suction time T1 is varied by adjusting the flow control valve 602a of the delay timer valve device 602, if the flow control valve 607a of the delay timer valve device 607 is left as it is, the specified time T2 also varies, and in order to keep constant the specified time T2 even if the suction time T1 is changed, it is necessary to adjust the flow control valve 607a, together with the flow control valve 602a.

Figure 6:
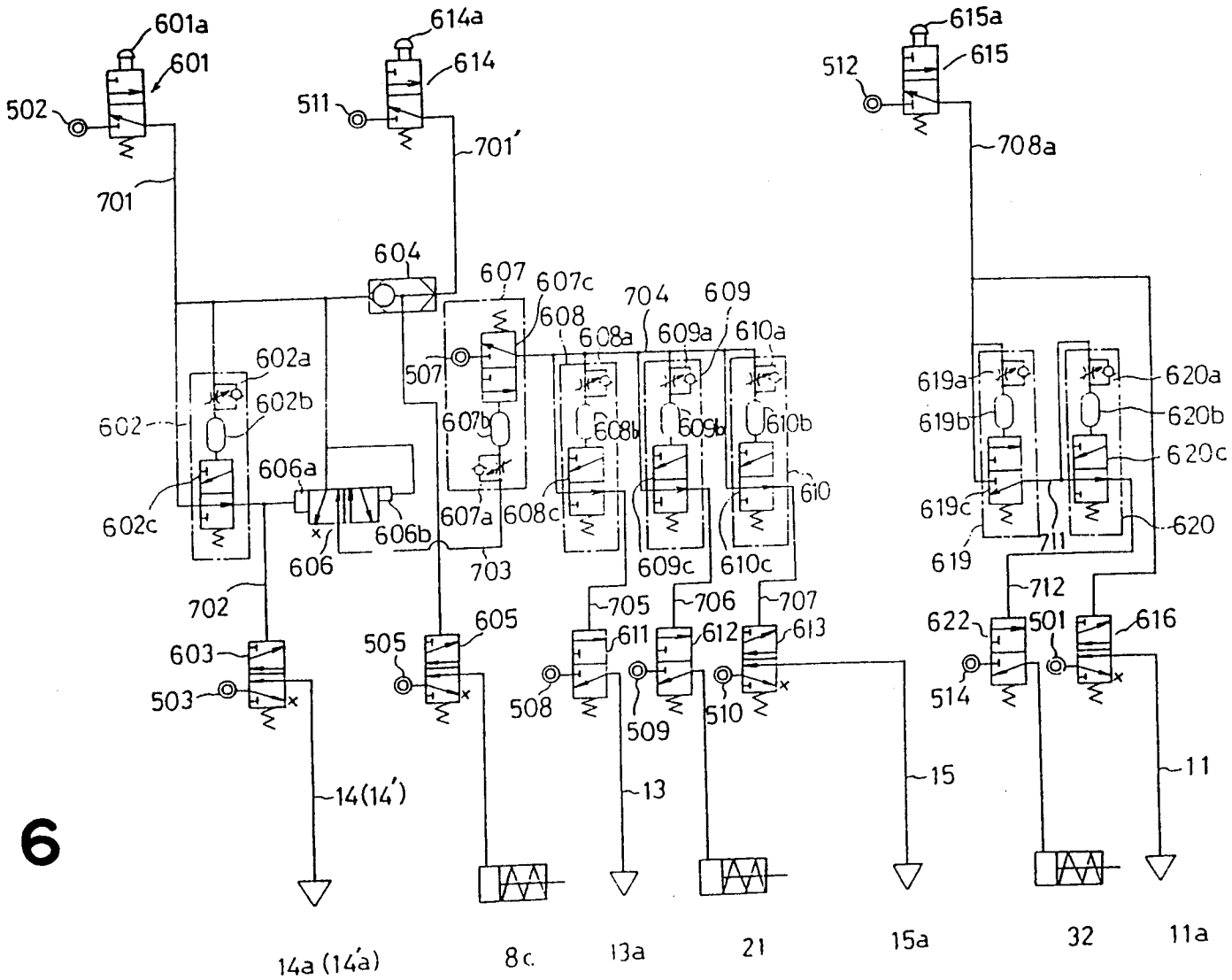
FIG. 6 is a diagram showing another modified example of the air pressure circuit.

FIG. 6 shows another pneumatic circuit diagram, in which the shuttle valve 617, pneumatic changeover valves 618, 621, pilot air supply device 513 and air supply line 710 are removed from the pneumatic circuit shown in FIG. 3, and an air supply line 708a in place of the air supply line 708 in FIG. 3 which is linked to the pilot air supply changeover valve 615 is linked to the changeover operation part of pneumatic changeover valve 616 and is also directly connected to the flow control valve 619a and changeover valve 619c of the delay timer valve 619 for setting the cutting start time. (Other parts in this pneumatic circuit diagram are identified with the same code numbers as in FIG. 3.) In the pneumatic circuit in FIG. 6, after pressing the plunger 615a of the changeover valve 615 for pilot air supply by driving the sewing machine, when the pressure on the plunger 615 is released by stopping the driving of the sewing machine, air is not delivered into the air supply line 708a regardless of the step of operation. Therefore, every time the sewing machine is driven, the second air cylinder 32 is driven, and when forming seams continuously on plural edges of one cloth, the second air cylinder 32 moves purposelessly when forming seams on the second and subsequent edges. However, the pneumatic circuit shown in FIG. 6 is, indeed, capable of realizing the operation of this invention.

As clearly understood from the description of FIG. 5 and FIG. 6, the operation of this invention may also be realized by removing the differential area double pilot valve from the pneumatic circuit of FIG. 3 as shown in FIG. 5, and using a pneumatic circuit without a shuttle valve 617, pneumatic changeover valves 618, 621, pilot air supply source 513 and air passage 710.

Figure 7:
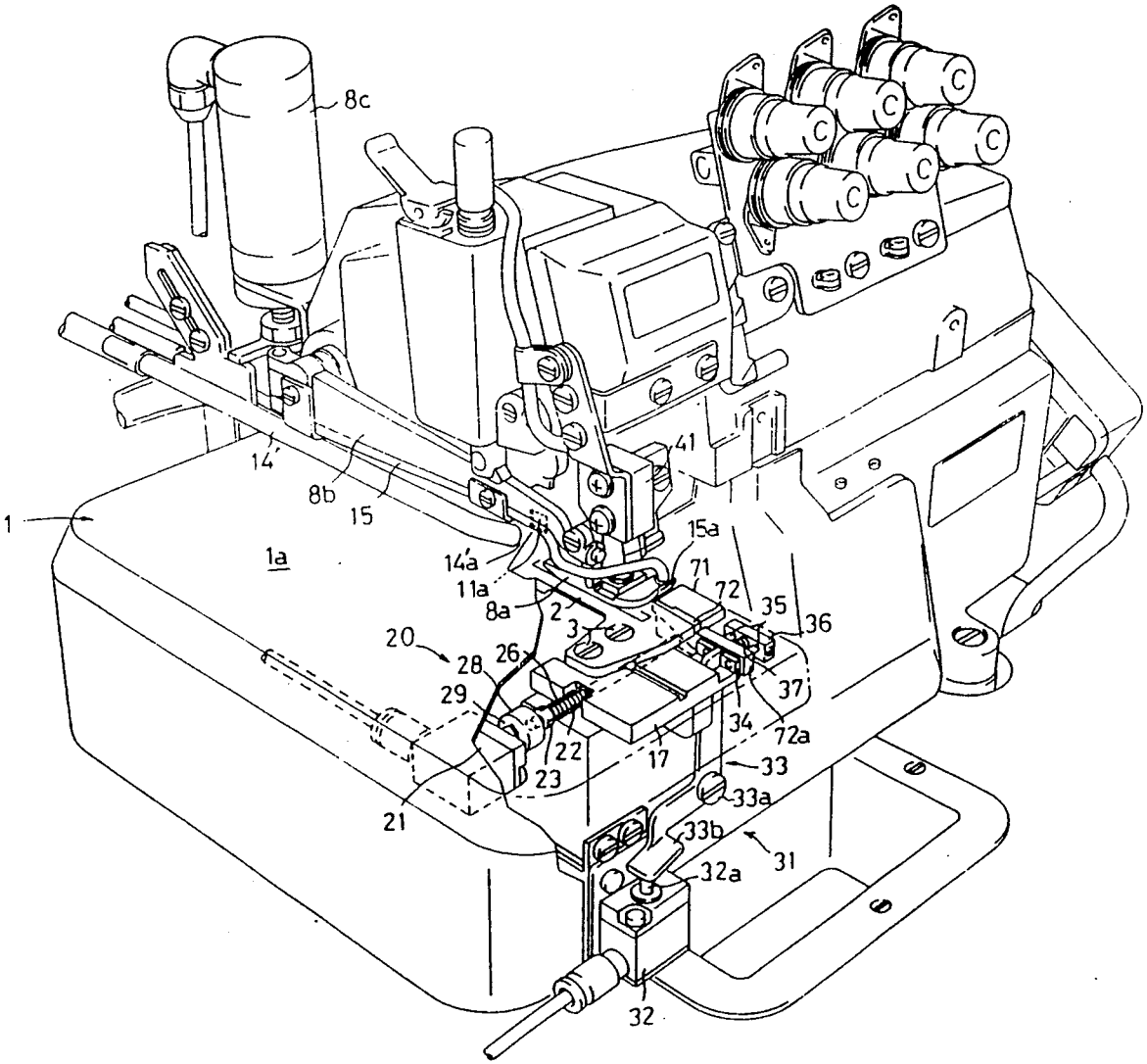
FIG. 7 is a perspective view showing a modified example of the device of FIG. 1.

FIG. 7 shows a modified example of the chaining thread sew-in device shown in FIG. 1. In this example, instead of the suction tube 14 disposed in the cloth plate 1, a suction tube 14' is disposed on the working face 1a, and the suction port 14'a of this suction tube 14' is disposed on the extension along the sewing axis X extending from the top of the tongue 5 and also in the vicinity of the suction hole 11a of the chaining thread cutter 10. As thus comprised, it is not necessary to drill a hole for a suction port in the cloth plate 1 as in the case of FIG. 1, but the suction tube 14' must be removed from the working face 1a, when sewing the cloth, so as not to disturb the passing of the cloth. The means to move the suction tube 14' to a position not to interfere with the passing of the cloth from above the working face la may be a slide method to move the suction tube 14' back from above the working face 1a, or a method to rotate the suction tube 14' around a specified position so that the suction tube 14' may draw an arc. Thus, when disposing the suction tube 14' on the working face 1a, it is necessary to move the suction tube 14' onto the working face la only when sucking. This operation may be automated, for example in the pneumatic circuit shown in FIG. 3, by adding a circuit arrangement for pressing the operating part 601a of the changeover valve 601 for pilot air supply to connect the air supply source 503 for sucking the chaining thread and the suction tube 14' and also to move this suction tube 14' to a specified position on the working face 1a, and disconnecting the air supply source 503 for sucking the chaining thread and the suction tube 14' and moving the suction tube 14' to a position not to disturb the passing of the cloth from above the working face 1a.

The chaining thread sew-in device of this invention is not driven by using the pneumatic circuit of the above embodiment alone, but, by using a solenoid and others instead of an air cylinder and others, the device may be driven by an electric circuit, or an electric circuit together with a hydraulic circuit.

Figure 8:
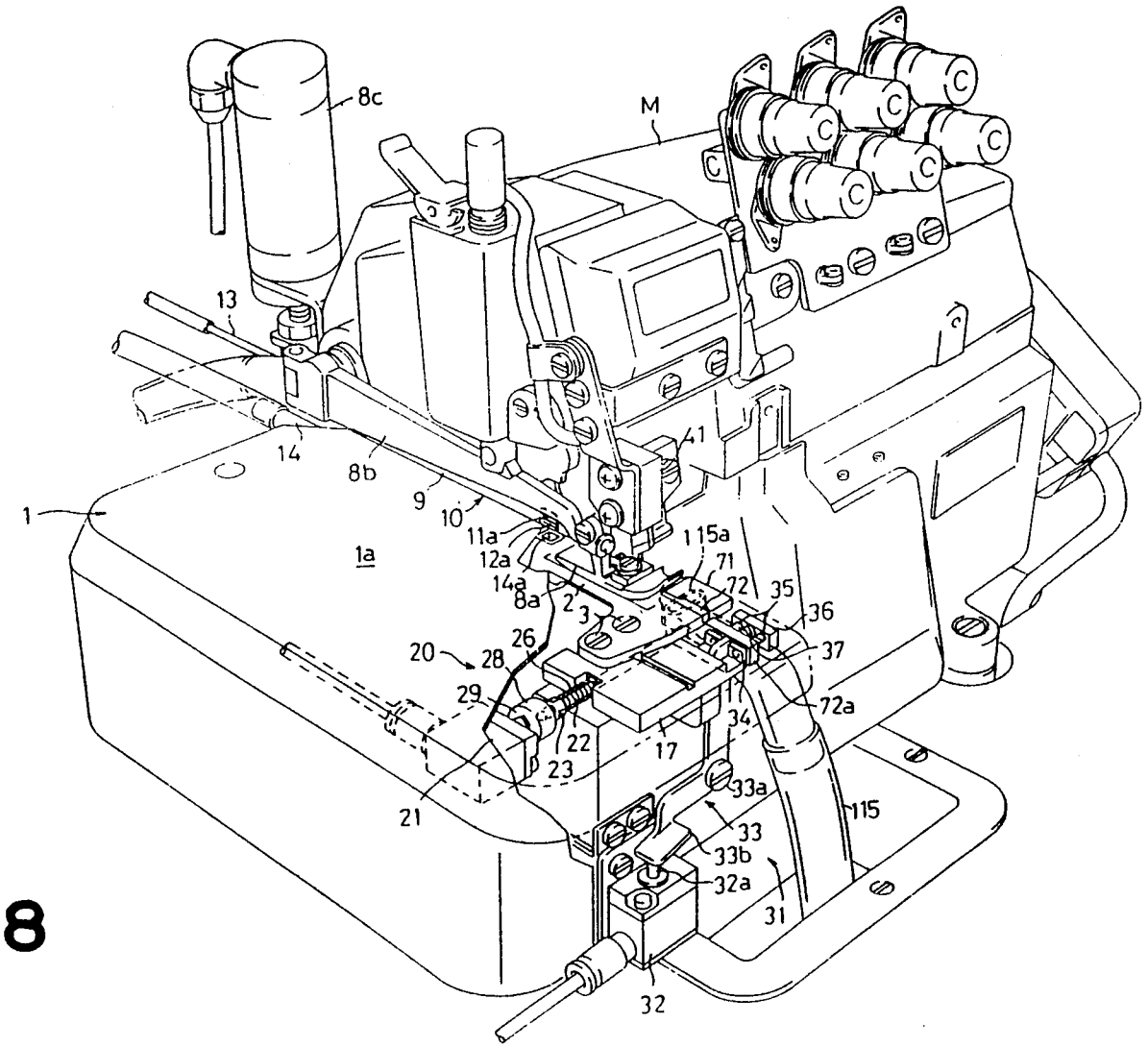
FIG. 8 is a perspective view cutting away part of the chaining thread sew-in device of an overlock sewing machine in a different embodiment of this invention.
Figure 9:
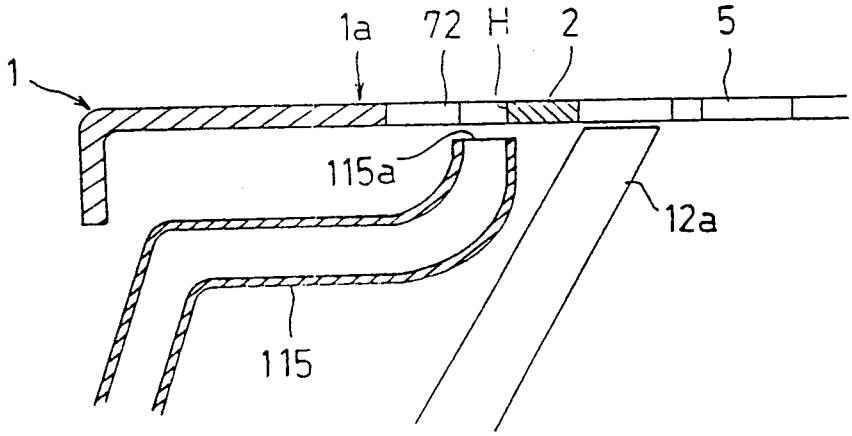
FIG. 9 is a partial schematic sectional view of the device of FIG. 8.
Figure 10:
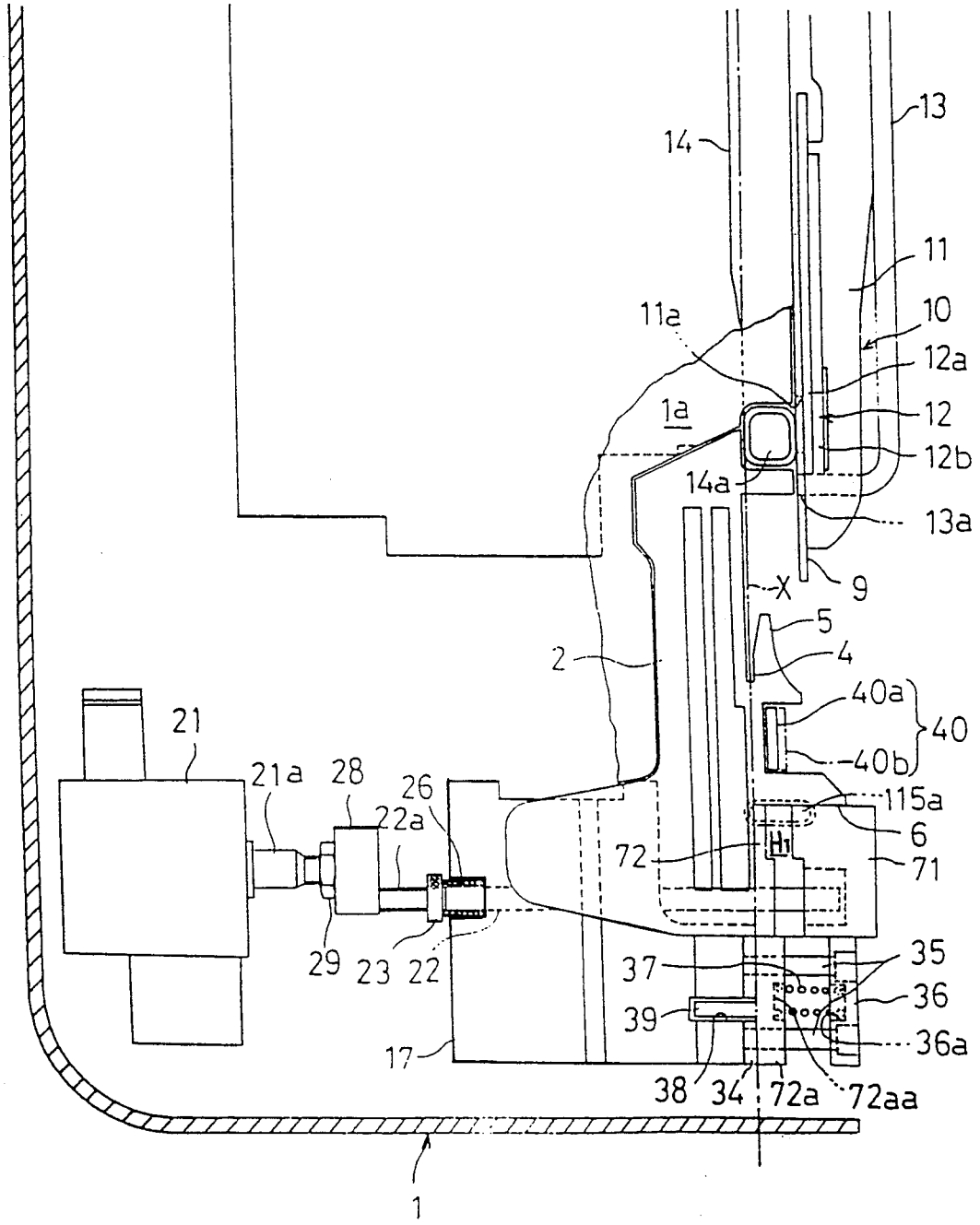
FIG. 10 is a schematic plan view of essential parts, cutting away the cloth plate, of the device of FIG. 8.

The chaining thread sew-in device in a different embodiment of this invention is described herein by referring to the partially cut-away perspective view in FIG. 8, a partial schematic sectional view of FIG. 8 in FIG. 9, and a schematic sectional view of essential parts, cutting away the cloth plate, of the device of FIG. 8 in FIG. 10.

The chaining thread sew-in device shown in FIG. 8 to FIG. 10 is different from the preceding embodiment shown in FIG. 1 in that the blow pipe 15 in FIG. 1 is replaced by a suction tube 115. Therefore, other constituent parts are identified with the same code numbers as in FIG. 1 and FIG. 2A to FIG. 2F.

The suction tube 115 is disposed behind the working face 1a as shown in FIG. 9. The suction port 115a of this suction tube 115 is opened upward beneath the insertion hole $H_1$ opened by driving the plate 71 by a first drive mechanism 20 as shown in FIG. 10.

This suction tube 115 is connected to an air suction source (not shown). That is, in the preceding embodiment, the blow pipe 15 was intended to blow the free end of the chaining thread moved to the nearer side of the needle location 4 by the air blown out from the nozzle 13a of the air pressure feed tube 13 into the insertion hole $H_1$ from above the working face 1a, whereas the suction tube 115 of this embodiment is designed to insert the free end of the chaining thread into the insertion hole $H_1$ by sucking it from beneath the working face 1a. Therefore, in the pneumatic circuit shown in FIG. 3, FIG. 5 and FIG. 6, the blow pipe 15 and its nozzle 15a are replaced by the suction tube 115 and suction port 115a, and the driving air supply source 510 is replaced by an air suction source, and this new pneumatic circuit can operate exactly the same as shown in the preceding embodiment illustrated in FIG. 2A to FIG. 2F.

Figure 12B:
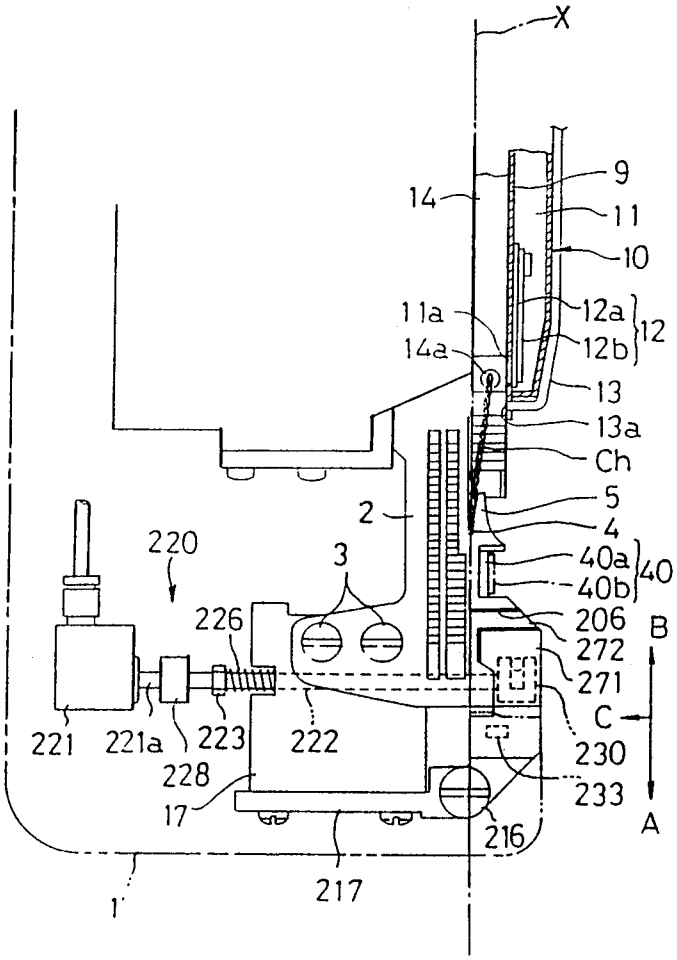
FIG. 12A to FIG. 12E are schematic plan views of essential parts, cutting away the cloth plate, showing the treating processes of the chaining thread by the device of FIG. 11.
Figure 13:
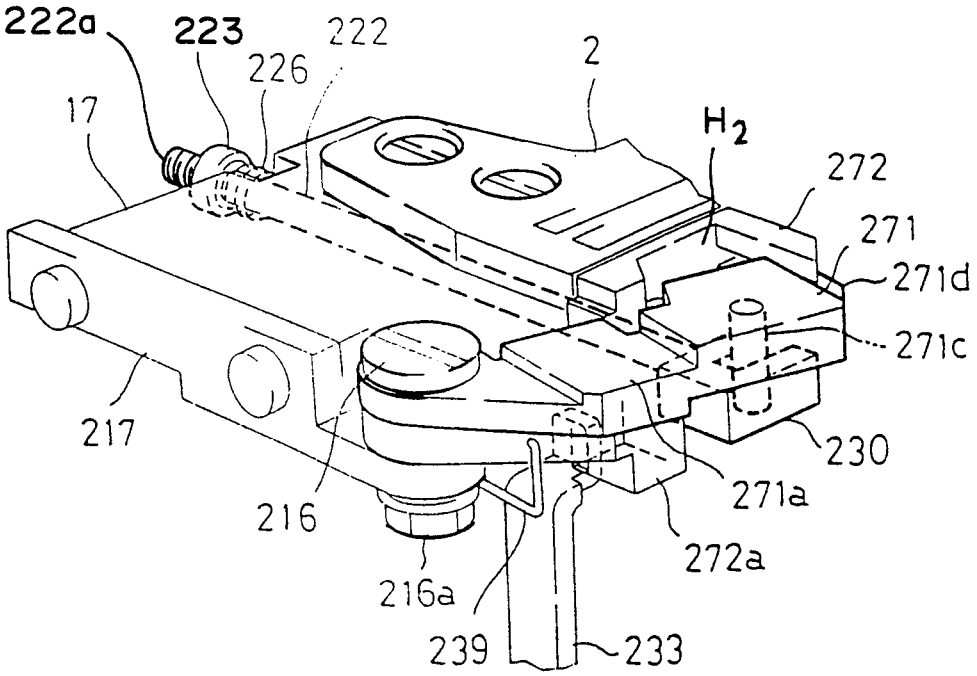
FIG. 13 is a magnified perspective view showing the essential parts of the device of FIG. 11.
Figure 14:
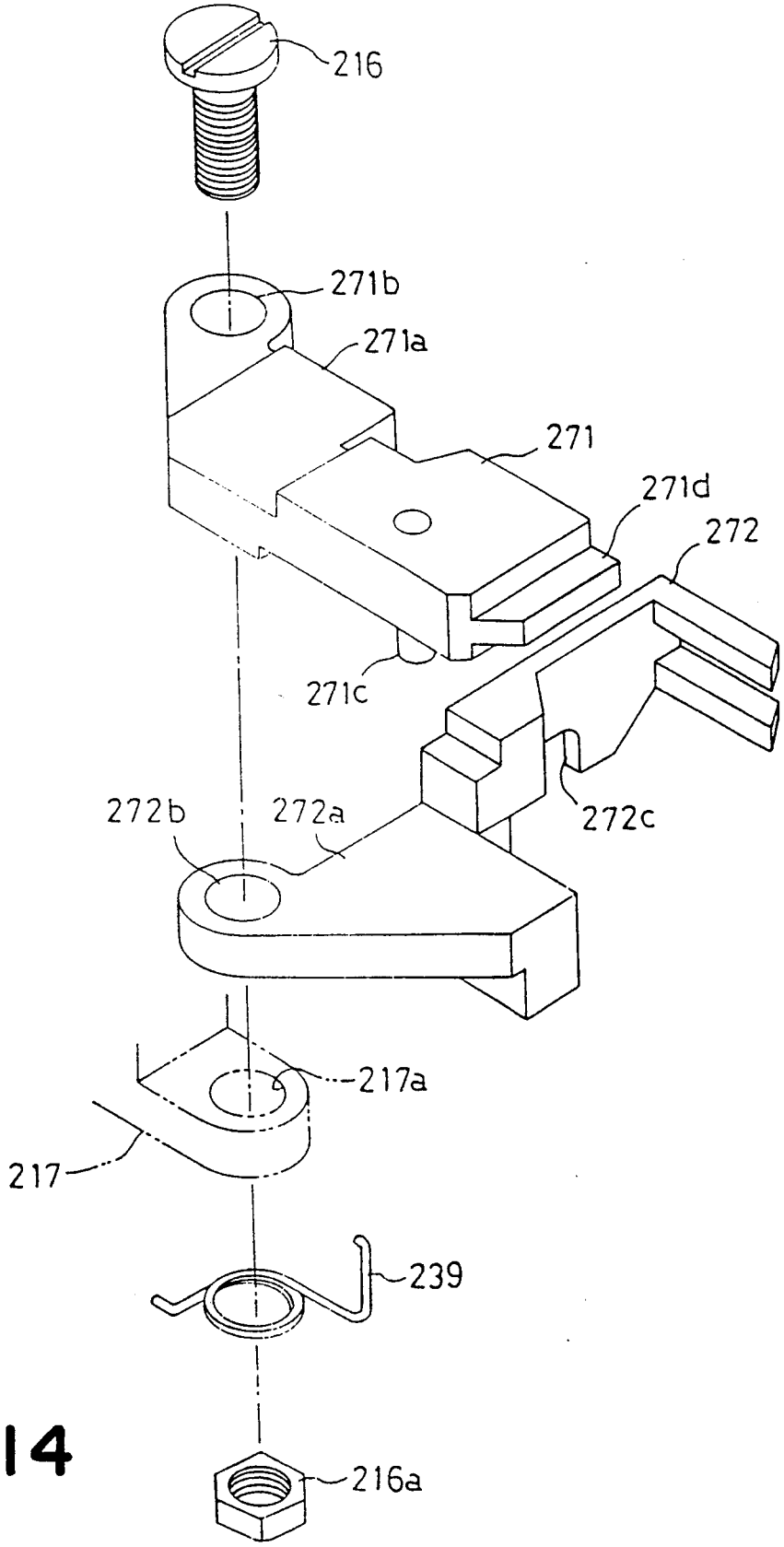
FIG. 14 is an exploded perspective view of a pinching plate.

A still further embodiment of the chaining thread sew-in device of this invention is described below by referring to the partially cut-away perspective view in FIG. 11, the schematic plan views of essential parts, cutting away the cloth plate, to explain the chaining thread treating processes in FIG. 12A to FIG. 12E, the magnified perspective view of essential parts in FIG. 13, and the exploded perspective view of the pinching plate in FIG. 14.

The chaining thread sew-in device shown in FIG. 11 to FIG. 14 is different from the chaining thread sew-in device of the embodiment shown in FIG. 1 in that the pinching plate 71 and sub-pinching plate 72 are replaced by a pinching plate 271 and a sub-pinching plate 272, and that the first drive mechanism 20 and second drive mechanism 31 are replaced by a first drive mechanism 220 and a second drive mechanism 231. The other parts of this device are the same as those shown in FIG. 1, and are identified with the same reference numbers.

The pinching plate 271 and sub-pinching plate 272, like the pinching plate 71 and sub-pinching plate 72, are detachably inserted into a recess 206 formed in the working face 1*a* at the tongue 5 side of the sewing axis and at the nearer side of the needle location 4 (the arrow A direction in FIG. 12A to FIG. 12E), and their upper surfaces are level with the working face 1*a*.

The sub-pinching plate 272 is formed in an L-shape as seen from the plane along the bottom of the recess 206 and one side at the forward side, and the pinching plate 271 is designed to fit into the L-corner of the sub-pinching plate 272. The pinching plate 271 and sub-pinching plate 272 contact with each other on the side parallel to the sewing axis X. By the mechanism described later, the pinching plate 271 can escape alone from the recess 206, so that an insertion hole of the free end of the chaining thread can be opened against the sub-pinching plate 272 as shown in FIG. 12C. On the other hand, as the sub-pinching plate 272 rotates, the pinching plate 271 also rotates in cooperation. Incidentally, one side at the front side of the sub-pinching plate 272 is, as shown in FIG. 14, branched into upper and lower parts, and when the pinching plate 271 and sub-pinching plate 272 contact each other, a protuberance 271*d* formed at the end of the pinching plate 271 fits into this branching-off part of the sub-pinching plate 272.

The drive mechanisms of pinching plate 271 and sub-pinching plate 272 are described below.

On the pinching plate 271 is integrally formed an arm 271*a* extending to the sewing machine nearer side through beneath the cloth plate 1, and a bolt penetration hole 271*b* is formed in the end of this arm 271*a*. On the sub-pinching plate 272, meanwhile, an arm 272*a* contacting with the arm 271*a*, extending to the sewing machine front side passing further beneath the arm 271*a* integrally formed on the pinching plate 271 is formed integrally, and a bolt penetration hole 272*b* is formed in the end of this arm 272*a*. On the bracket 17 mounted on the sewing machine main body M, an auxiliary bracket 217 forming a bolt penetration hole 217*a* as shown in FIG. 13 at one end is bolted.

The arms 271*a*, 272*a* of the pinching plate 271 and sub-pinching plate 272 are rotatably mounted on the auxiliary bracket 217 by means of a bolt 216 penetrating through the respective bolt penetration holes 271*b*, 272*b* and bolt penetration hole 217*a* of the auxiliary bracket 217, so that the pinching plate 271 and sub-pinching plate 272 are designed to rotate on the working face 1*a*. Numeral 216*a* denotes a nut for coupling the pinching plate 271, sub-pinching plate 272 and auxiliary bracket 217, being screwed into bolt 216. Numeral 239 is a torsion spring wound around the bolt 216. This torsion spring 239 thrusts the sub-pinching plate 272 to the side to contact with the throat plate 2, with its one end abutting against the arm 272*a* which is integral with the sub-pinching plate 272 and the other end engaging with the bracket 17.

The pinching plate 271 is driven by operating the first air cylinder disposed beneath the cloth plate 1.

That is, a columnar operation stud 271*c* projects from the lower surface of the pinching plate 271, and this operation stud 271*c* is engaged with an engaging member 230 penetrating through the bracket 17 and the sub-pinching plate 272 in the direction orthogonal to the sewing axis X and provided at one end of a rod 222 supported slidably by the bracket 17. Numeral 272*c* shown in FIG. 14 is a recess for penetration of the rod 222 formed on the sub-pinching plate 272. The engaging member 230 is a bifurcate shape opened at the front side, and in this bifurcate interval the operation stud 271*c* is slidably pinched. The rod 222, male threads 222*a* in FIG. 13, spirally formed on the protuberance from the bracket 17 of this rod 222, spring stopper 223 spirally fitted on the male threads 222*a*, and compression spring 226 stretched between the spring stopper 223 and bracket 17 are composed exactly the same as the rod 22, male threads 22*a*, spring stopper 23, and compression spring 26 in the embodiment shown in FIG. 1, and the pinching plate 271 engaged with the rod 222 is thrust in the direction to contact with the sub-pinching plate 272 (the arrow C direction in FIG. 12A to FIG. 12E) by the thrusting force of the compression spring 226. Incidentally, the rod pressure member 228 mounted on the piston rod 221*a* of the first air cylinder 221 is also identical with the rod pressure member 28 in the embodiment shown in FIG. 1, and hence as the first air cylinder 221 extends the piston rod 221*a*, the rod pressure member 228 presses the rod 222 by overcoming the thrusting force of the compression spring 226. That is, the first drive mechanism 220 to drive the pinching plate 271 is composed of the first air cylinder 221, rod 222, spring stopper 223, compression spring 226, rod pressure member 228 and engaging member 230.

The sub-pinching plate 272 is driven by the second air cylinder 232 installed in the lower part of the cloth plate 1. That is, the end of the rocker arm 233 for transmitting the operation of the second air cylinder 232 is abutting against the side wall of the arm 272*a* integrally formed on the sub-pinching plate 272. This rocker arm 233 is formed in an L-shape, and a rod receiver 233*b* is formed at the end of one side extending in the lateral direction, and it operates the same as the rocker arm 33 in the embodiment shown in FIG. 1. That is, when the piston rod 232*a* of the second air cylinder 232 is extended to push up the rod receiver 232*b*, the rocker arm 233 oscillates around the corner 233*a*, and the end part abutting against the arm 272*a* of the sub-pinching plate 272 presses the arm 272*a* in the direction remote from the sewing axis X, overcoming the thrusting force of the torsion spring 239. When the arm 272*a* is thus pressed, the sub-pinching plate 272 integrally formed on the arm 272*a* turns in cooperation with the pinching plate 271 around the bolt 216 in the direction to escape from the recess 206. At this time, it is evident that the pinching plate 271 rotates by resisting the thrusting force of the compression spring 226. Besides, when the piston rod 232*a* of the second air cylinder 232 is drawn back, the end of the rocker arm 233 returns to the initial position, and the arm 272*a* is thrust by the torsion spring 239, so that the sub-pinching plate 272 rotates up to the position to abut against the throat plate 2 on the sewing axis X. Moreover, when the sub-pinching plate 272 thus rotates, the pinching plate 271 also rotates toward the sewing axis X in cooperation with the sub-pinching plate 272 by the thrusting force of the compression spring 226.

When the second air cylinder 232 is operated in this way, the pinching plate 271 and sub-pinching plate 272 rotate in cooperation in the mutually contacting state.

Namely, the second drive mechanism 231 to drive the sub-pinching plate 272 is composed of the second air cylinder 232, rocker arm 233 and torsion spring 239.

Figure 11:
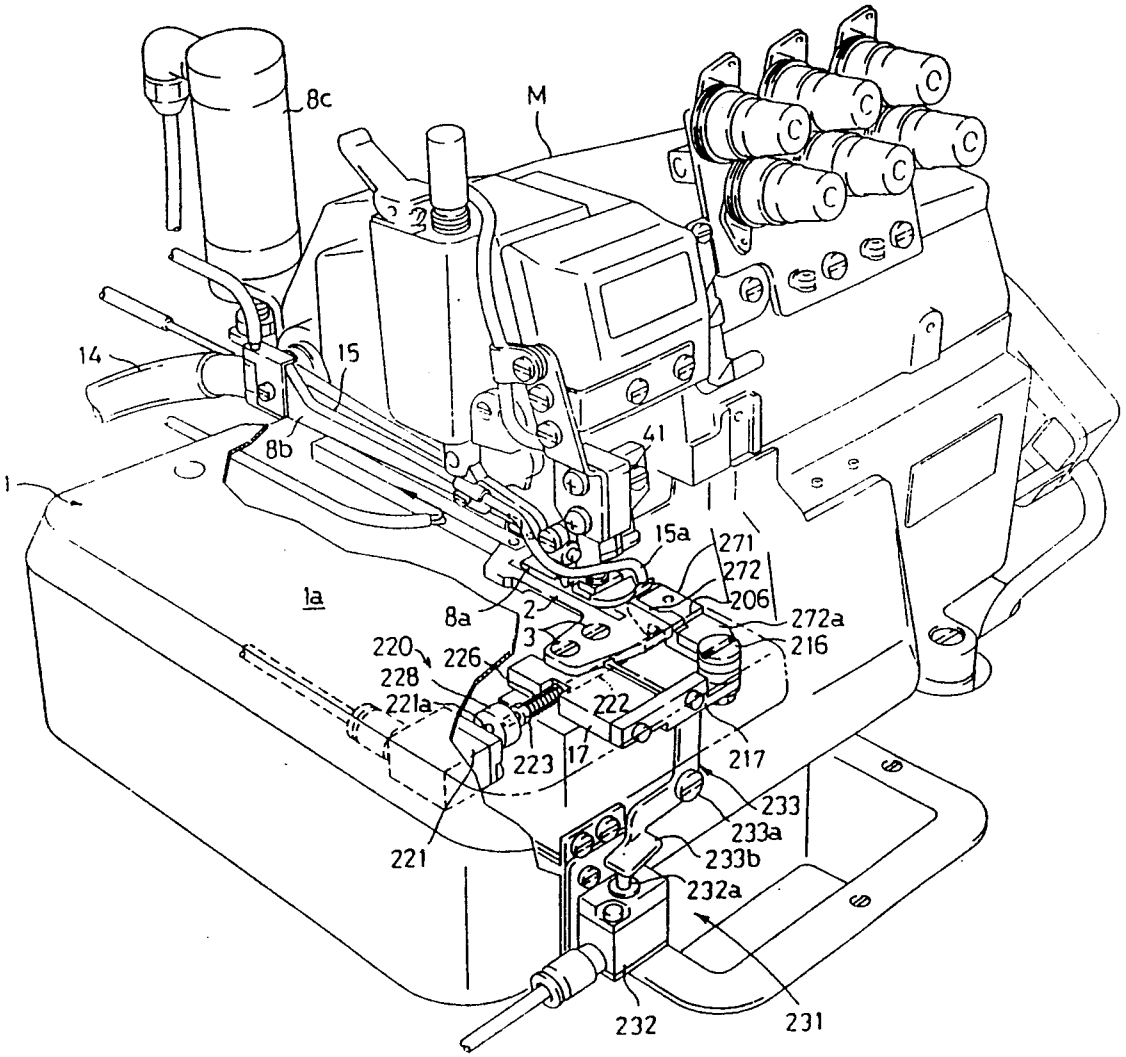
FIG. 11 is a partially cut-away perspective view of the chaining thread sew-in device of an overlock sewing machine in a further different embodiment of this invention.

The chaining thread sew-in device of this invention shown in FIG. 11 can be operated by using the pneumatic circuits shown in FIG. 3, FIG. 5 and FIG. 6 which are constituted to operate the chaining thread sew-in device of FIG. 1. The chaining thread treating process by the device of this embodiment is described below.

Figure 12A:
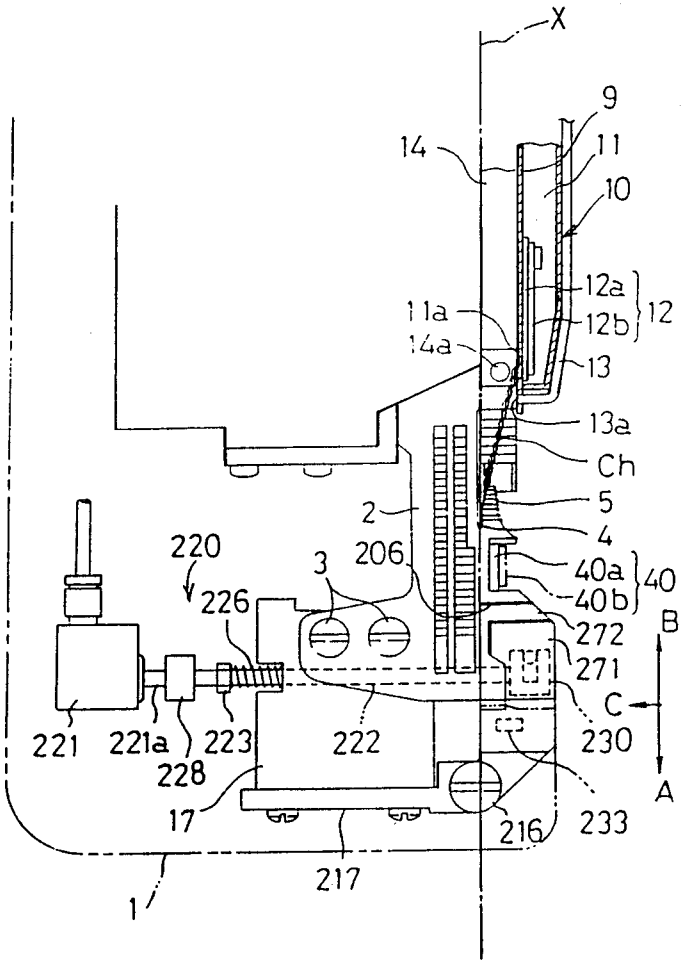

FIG. 12A shows the state of suction of the chaining thread Ch cut off from the cloth by the chaining thread cutter 10 into the suction hole 11*a* of the suction passage 11.

FIG. 12B shows state of the stretching of the entire chaining thread Ch as the base end part side of the chaining thread Ch is pulled out of the tongue 5 when the free end of the chaining thread Ch is sucked into the suction port 14*a* of the suction tube 14.

By using such an air circuit, suction is stopped at a specified time after start of suction by the suction port 14*a*, and air is blown out from the nozzle 13*a* of the air pressure feed tube 13, while the first air cylinder 221 is operated to extend the piston rod 221*a*, so that air is also blown out from the nozzle 15*a* of the blow pipe 15.

When air is blown out from the nozzle 13*a*, the chaining thread Ch rotates about the vicinity of the end of the tongue 5, and the free end of this chaining thread Ch is moved toward the nearer side of the sewing machine. Thus, while the free end of the chaining thread Ch is moving, the piston rod 221*a* of the first air cylinder 221 is extended, and the pinching plate 271 rotates around the bolt 216. By this rotation, at the nearer side of the sewing machine, as shown in FIG. 12C, a chaining thread insertion hole $H_2$ is formed, and the free end side of the chaining thread Ch is sucked into this insertion hole $H_2$ by the air blown out from the nozzle 15*a*.

After the chaining thread Ch is blown into the insertion hole $H_2$ in this manner, the driving of the first air cylinder 271 is stopped, and the piston rod 221*a* is drawn back, then the pinching plate 271 rotates in the reverse direction due to the thrusting force of the compression spring 226, so that the insertion hole H is closed.

Figure 12D:
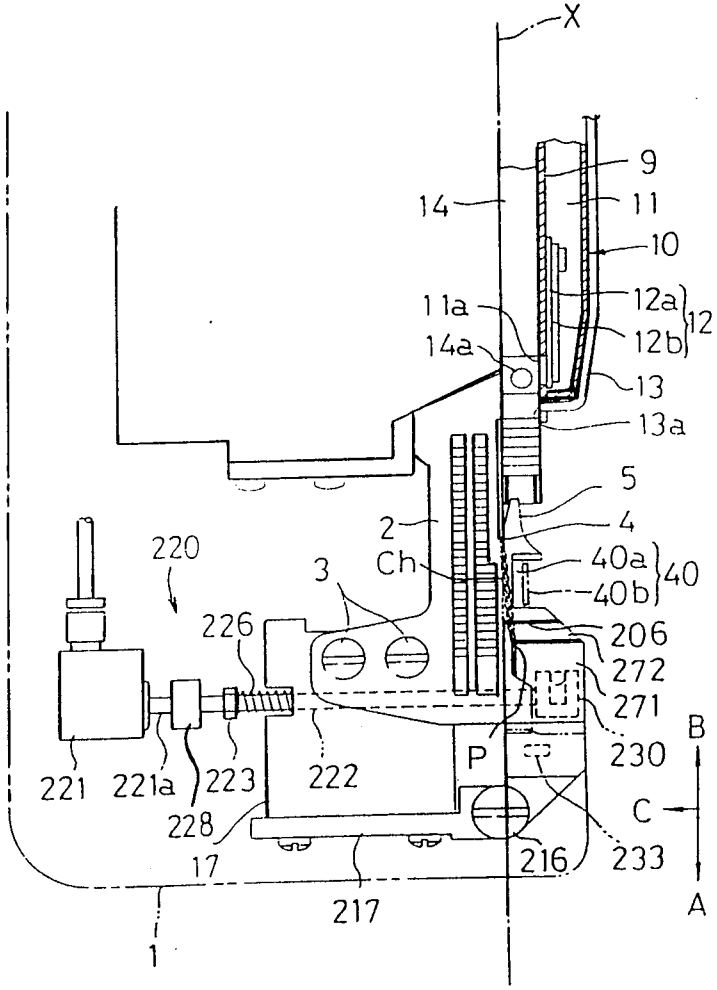
Figure 12C:
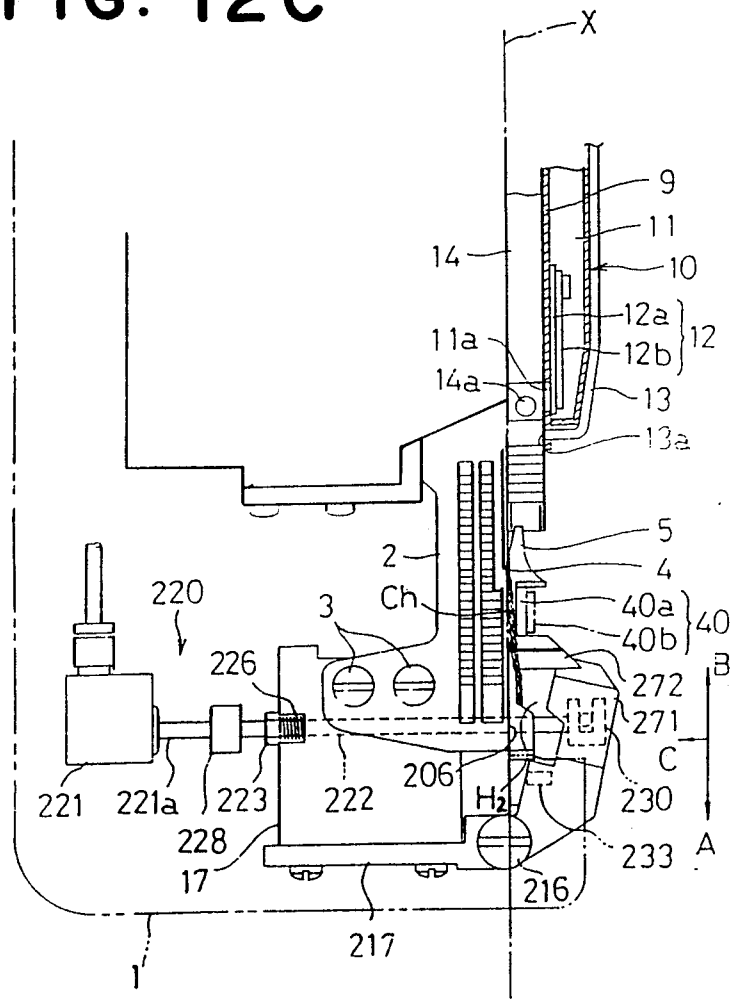

FIG. 12D shows the state of pinching of the chaining thread Ch in a taut status between the pinching plate 271 and sub-pinching plate 272.

Figure 12E:
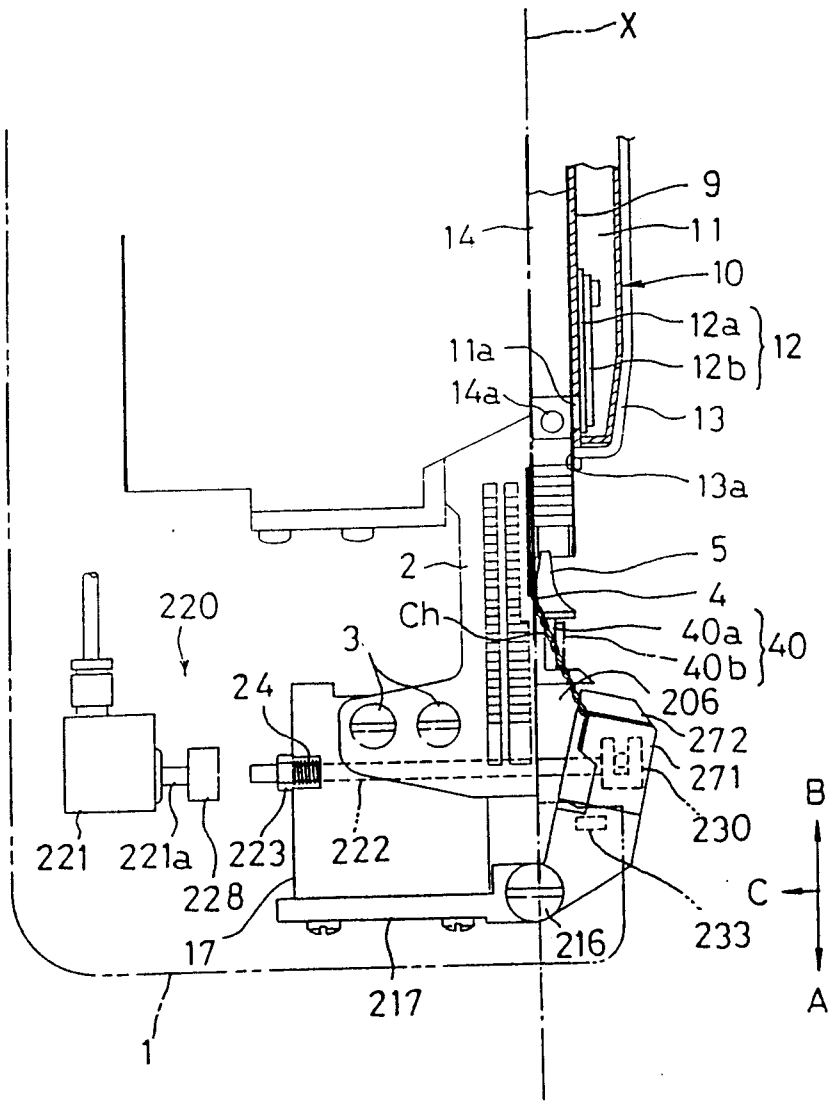

In the next step, the cloth is pinched between the presser foot 8*a* and throat plate 2, and the sewing machine is driven in this state to form seams on the edge of the cloth, and at a specified time after start of driving of the sewing machine for forming seams, the second air cylinder 232 is operated and the piston rod 232*a* of the second air cylinder 232 is extended, then the piston rod 232*a* of this second air cylinder 232 pushes up the rod receiver 233*b* of the rocker arm 233, so that the rocker arm 233 oscillates around the corner 233*a* by this pressure. As a result of this oscillation, the upper end of the rocker arm 233 presses the arm 272*a* integrally formed on the sub-pinching plate 272, by operating the thrusting forces of the torsion spring 239 which is thrusting the sub-pinching plate 272 to the side to contact with the throat plate 2 and the compression spring 226 which is thrusting the pinching plate 271 to the side of the sub-pinching plate 272. As a consequence, the pinching plate 271 and the sub-pinching plate 272 rotate in cooperation to the side of bringing the chaining thread Ch closer to the cutter 40 while pinching the chaining thread Ch. FIG. 12E shows the state of the insertion of the chaining thread Ch between the fixed knife 40*a* and movable knife 40*b*, crossing over the cutter 40, along with the above rotation. By crossing over the cutter 40 in this way, the chaining thread Ch sewn into the seams of the cloth is cut off from the pinching part of the pinching plate 271 and sub-pinching plate 272.

Thus, in the chaining thread sew-in device of the embodiment shown in FIG. 11, too, the length of the chaining thread sewn into the cloth can be varied by the timing to rotate the pinching plate 271 and sub-pinching plate 272 in cooperation, and the length of the chaining thread to be sewn in the cloth can be selected by varying the specified time from driving of the sewing machine till operation of the second air cylinder 232.

According to the embodiment shown in FIG. 11 to FIG. 14, the sub-pinching plate 272 is formed in an L-shape running along the bottom side and one front side of the recess 206 formed on the working face 1*a*, and the pinching plate 271 is fitted into the corner of this L-shape, so that the gripping point P (see FIG. 12D) of the chaining thread Ch by the pinching plate 271 and sub-pinching plate 272 is determined accurately, and the line connecting this gripping point P and the forming part of the chaining thread Ch is determined always in a stable position. Therefore, the chaining thread Ch pinched at the gripping point P, in its movement by turning the sub-pinching plate 72, crosses with the cutter 40 always at a specified position, and is cut off by the cutter 40 without causing cutting failure or other defect.

In the chaining thread sew-in device of the embodiment shown in FIG. 11 to FIG. 14, too, as the means for inserting the chaining thread into the insertion hole $H_2$ instead of the insertion means by blowing using the blow pipe 15, it is possible to use the insertion means by suction from beneath the insertion hole H the same as in the suction tube 115 shown in the embodiment in FIG. 8. Or, moreover, the suction tube 14 for elongating the chaining thread by pulling out of the tongue 4 may be provided above the working face la as in the case of suction tube 14' in the embodiment shown in FIG. 7.

In the chaining thread sew-in devices according to this invention shown in FIG. 1 to FIG. 14, commonly, the upper surfaces of the pinching plate and sub-pinching plate are level with the working face, and form part of this working face, so that these pinching plates will not disturb the cloth inserted onto the throat plate from the nearer side of the sewing machine. Moreover, the chaining thread pinched between the pinching plate and sub-pinching plate can be cut off from the gripping part, leaving a specified length, by driving the sub-pinching plate, so that the length of the chaining thread to be sewn into the seams of the next cloth can be varied properly.

Figure 15:
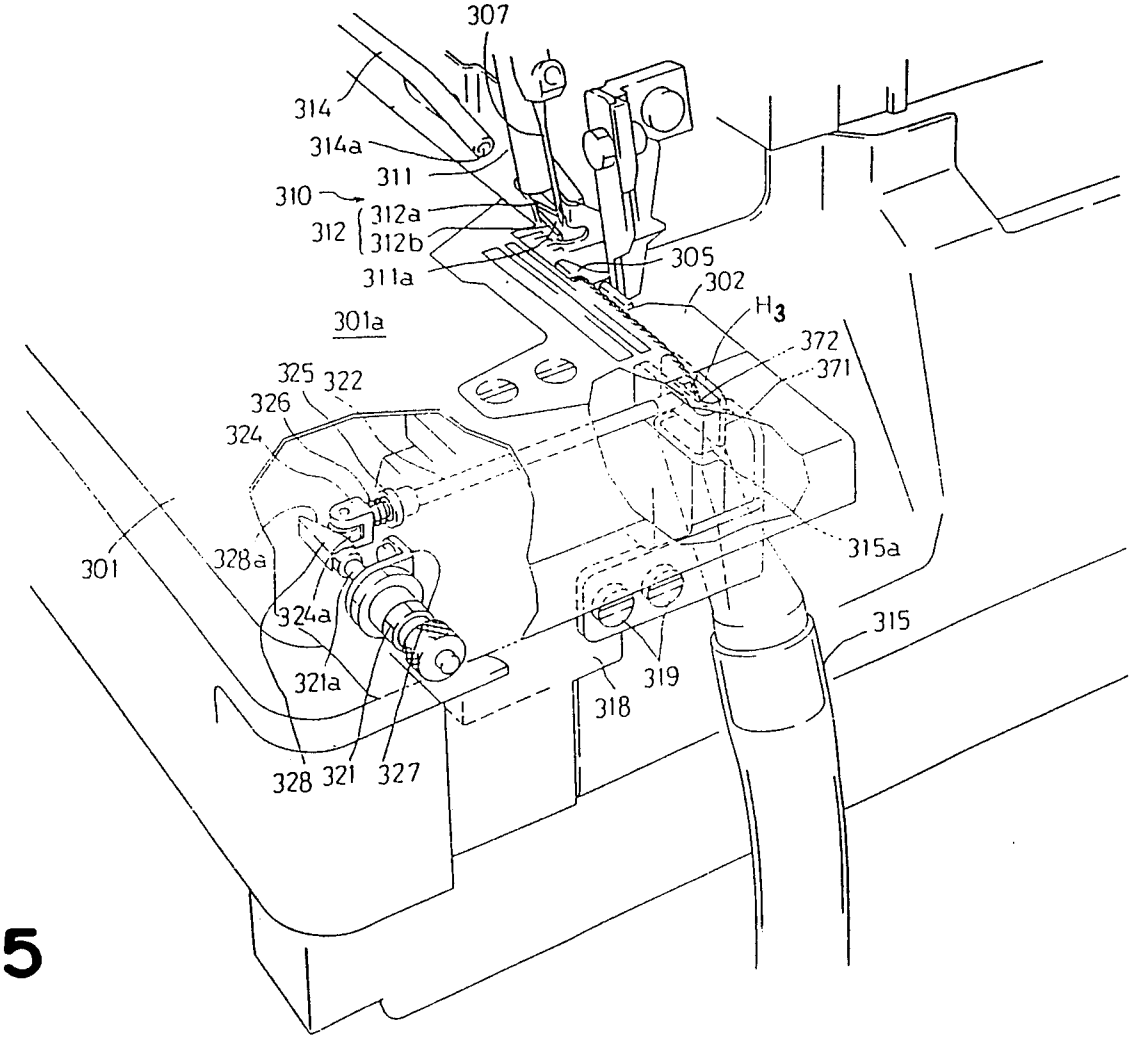
FIG. 15 is a partially cut-away perspective view showing the essential parts of the chaining thread sew-in device of an overlock sewing machine of still another embodiment of this invention.
Figure 16B:
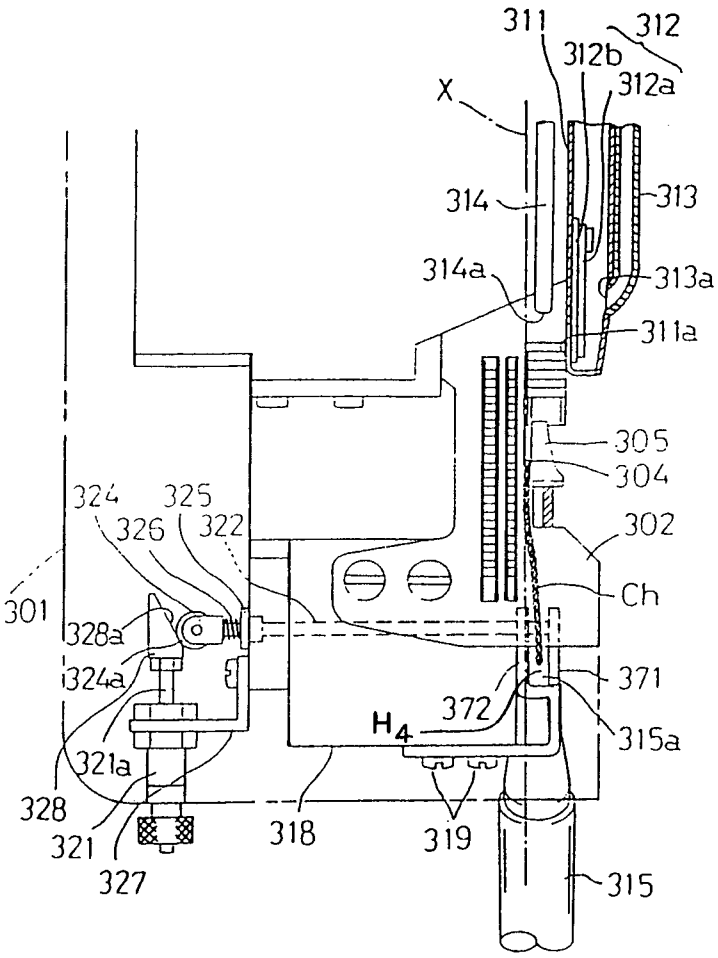
FIG. 16A to FIG. 16C are plan views, omitting the cloth plate, showing the treating processes of the chaining thread by the device of FIG. 15.
Figure 16A:
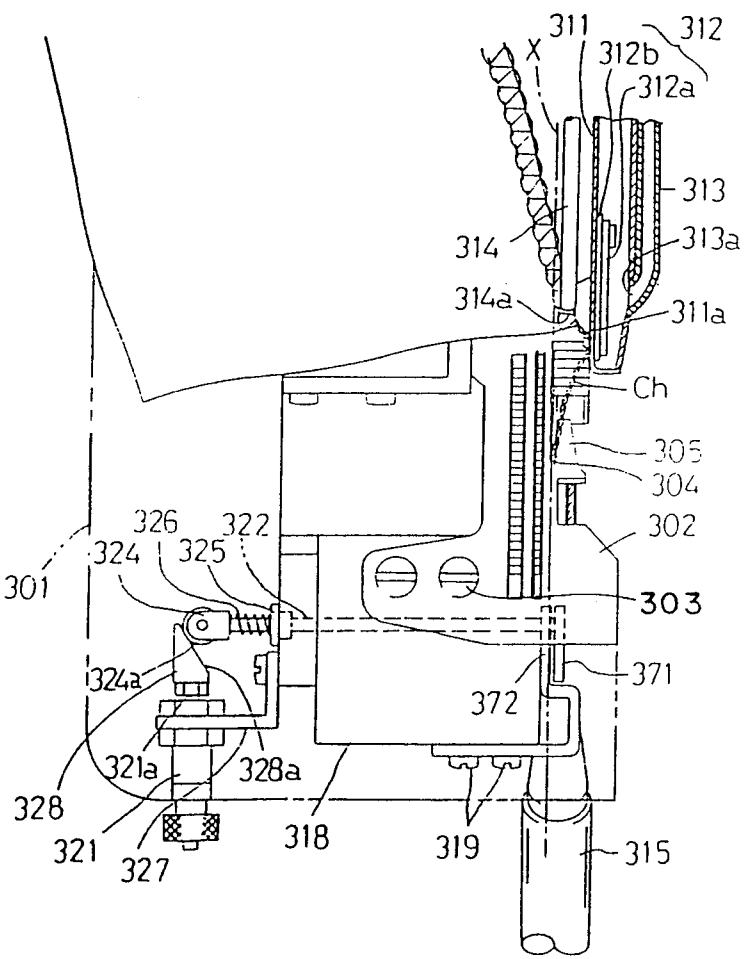
Figure 16C:
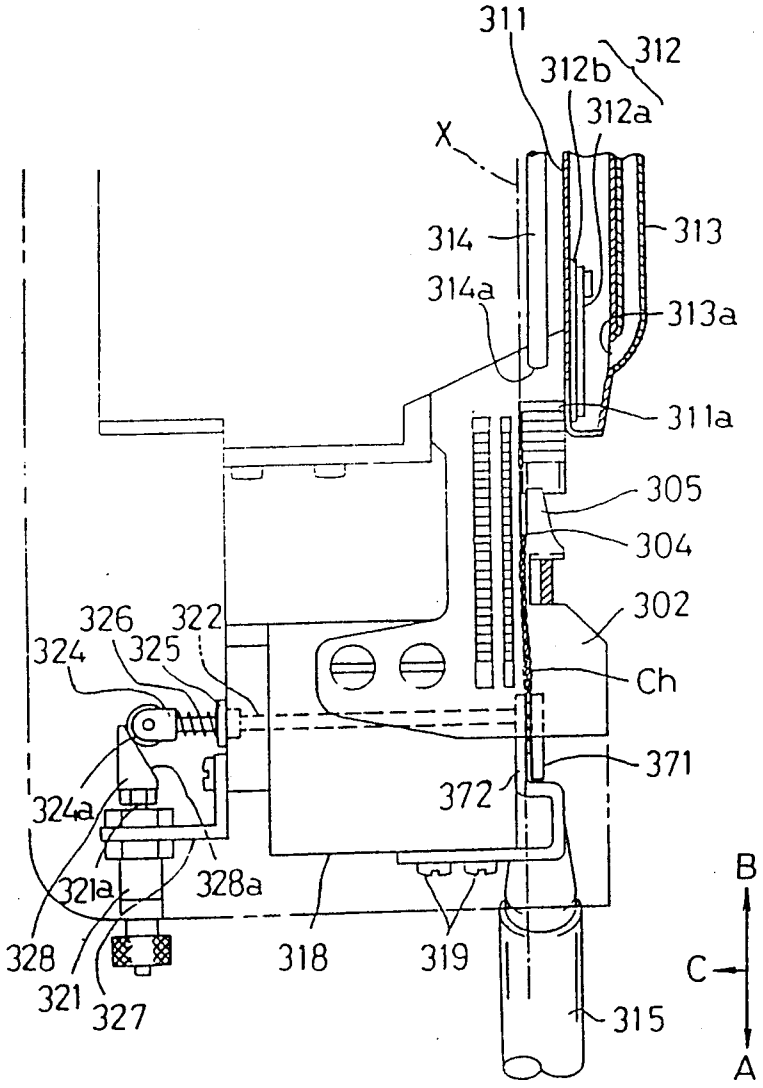

Another different embodiment of this invention is described below. FIG. 15 is a partially cut-away perspective view showing essential parts of this embodiment, and FIG. 16A to FIG. 16C are plan views, omitting the cloth plate, showing the treating processes of the chaining thread by the chaining thread sew-in device shown in FIG. 15.

In the working face 301*a* of the cloth plate 301, a throat plate 302 is fitted in a position corresponding to a needle 307. This throat plate 302 is fixed to the bracket 318 by bolts 303, and its upper surface forms part of the working face 301*a*. The line X indicated by dot-dash line in FIG. 16A to FIG. 16C is the sewing axis of an overlock sewing machine which runs through the needle location 304 formed on the throat plate 302 and coincides with the cloth feed direction.

A chaining thread cutting part 310 is provided adjacently to the throat plate 302. This chaining thread cutting part 310 is composed of a suction passage 311 connected with an air suction source (not shown) with a suction port 311*a* opened outside of the sewing axis X and near the rear side of the needle location 304, and a 312 placed at the suction port 311*a*. This cutter 312 is composed of a fixed knife 312*a* fixed at the suction port 311*a*, and a movable knife 312*b* driven by a member interlocked with the main spindle of the sewing machine.

This chaining thread cutting part 310 first operates the air suction source, and sucks the chaining thread Ch consecutive with the terminal end of the cloth S into the suction port 311*a*, and drives the movable knife 312*b* to cut off the chaining thread attracted against the fixed knife 312*a*.

The chaining thread Ch thus cut off has the cut part as the free end, which is continuous with the sewing elements such as tongue 5 and needle 7 formed in contact with the needle location 4 of the throat plate 2.

In the suction passage 311 of the chaining thread cutting part 310, as shown in FIG. 16A to FIG. 16C, a first air pressure feed tube 313 connected with an air pressure feed source (not shown) is arranged parallel. The end of the nozzle 313*a* is set near the suction port 311*a* of the chaining thread cutting part 310, so that the air is blown into the direction to cross with the sewing axis X. Therefore, when air is blown out from the nozzle 313*a* after cutting off the chaining thread by the cutter 312, the chaining thread moves into the state to intersect with the sewing axis X around the sewing elements such as needle 7.

On the sewing axis X and behind the needle location 4, there is a second air pressure feed tube 314 for ejecting the air sent under pressure from the air supply source (not shown) through the nozzle 314*a*. The tip of the nozzle 314*a* is directed to the nearer side of the needle location 304. This second air pressure feed tube 314 blows out the air simultaneously with the first air pressure feed tube after cutting off the chaining thread by the cutter 312, or the second air pressure feed tube 314 blows out the air instead of the first air pressure feed tube 313, when the chaining thread is moved to a state to cross with the sewing axis X by the air blown out from the first air pressure feed tube 313, so that the free end of the chaining thread Ch is moved to the front side of the throat plate 2.

On the cloth plate 301 ahead of the throat plate 302, there is a chaining thread insertion hole H i.e., $H_1$ (FIG. 2D, FIG. 10); $H_2$ (FIG. 12C, FIG. 13); $H_3$ (FIG. 15, FIG. 16B); and $H_4$ (FIG. 17) penetrating to the rear side of the cloth plate 301, and beneath the chaining thread Ch are provided. The fixed plate 372 and pinching plate 371 are disposed in the state where mutual abutting faces are parallel to the sewing axis X, and the fixed plate 372 is bolted by bolts 319 to a bracket 318 which is integral with the sewing machine main body.

To the pinching plate 371 is fixed one end of a rod 322, and this rod 322 is extended in the direction to intersect with the sewing axis X, penetrating through a fixed plate 372 and a bracket 318. To this bracket 318 is fixed a spring stopper 325 through which the rod 322 penetrates, and a compression spring 326 is stretched between the roller bearing 324 affixed to the end of the rod 322 and the spring stopper 325. Therefore, usually, the pinching plate 371 is pressed to the fixed plate 372 by the elastic thrusting force of the compression spring 326.

To the bracket 318 is fixed an air cylinder 321 through a mounting fixture 327, and a taper member 328 is fixed to the piston rod 321*a* of this air cylinder 321. The taper surface 328*a* of this taper member 328 abuts against the roller 324*a* pivoted on the roller bearing 324. The taper member 328, as shown in FIG. 16B, presses the roller bearing 324 while rotating the roller 324*a* by overcoming the thrusting force of the compression spring 326 when the piston rod 321*a* is extended, so that the rod 322 is moved to the pinching plate 371 side. On the other hand, as shown in FIG. 16C, while the piston rod 321*a* of the air cylinder 321 is drawn back, the tapermember 328 is designed so as not to apply external force to the rod 322.

Therefore, when the piston rod 321*a* is extended by controlling the air cylinder 321, the pinching plate 372 fixed to the rod 322 is spaced from the fixed plate 371, so that both parts oppose each other at a spacing beneath the chaining thread insertion hole H.

Numeral 315 denotes a suction tube connected to an air suction source (not shown), and the suction port 315*a* of this suction tube 315 is opened upward beneath the location of the fixed plate 372 and pinching plate 371 and beneath the chaining thread insertion hole H. This suction tube 315, by sucking air simultaneously with blow-out of air from the second air pressure feed tube 314, sucks the free end of the chaining thread Ch moved ahead of the throat plate 2 by the second air pressure feed tube 314 into the suction port 315*a*. Therefore, by operating the air cylinder 321, the pinching plate 371 is spaced from the fixed plate 372, and when air is sucked in from the suction port 315*a* of the suction tube 315, the free end of the chaining thread Ch is sucked into the suction port 315*a* through the space between the fixed plate 372 and pinching plate 371. Therefore, later, when the pinching plate 371 is pressed against the fixed plate 372, the free end of the chaining thread Ch is pinched between these plates.

The thus comprised chaining thread sew-in device first cuts off the chaining thread created consecutive to the terminal end of a cloth by means of the chaining thread cutting part 10, leaving a proper length from the sewing elements such as needle 7, and blows the free end of the cut-off chaining thread toward the chaining thread insertion hole H before the throat plate 2 by the air blown out from the first air pressure feed tube 313 and second air pressure feed tube 314. At the same time, utilizing the air sucked into the suction port 315*a* of the suction tube 315, the free end of the chaining thread is sucked from beneath, and the air cylinder 321 is driven to extend the piston rod 321*a*, so that the free end of the chaining thread is inserted into the space kept between the fixed plate 372 and pinching plate 371. After inserting, the piston rod 321*a* of the air cylinder 321 is drawn back, and the free end of the chaining thread is placed between the fixed plate 372 and pinching plate 371. By thus setting, the chaining thread is arranged among the tongue 305 for creating the chaining thread by sewing elements such as needle 307, the pinching plate 371 and the fixed plate 372. Therefore, when a new cloth is set and linking is started on this cloth, as the cloth is fed in, the chaining thread is sewn into the seams in the lower surface of the cloth. At this time, since pinching of the free end of the chaining thread by pinching plate 371 and fixed plate 372 is effected by elastic thrust, the free end of the chaining thread escapes from the pinching parts, overcoming the thrusting force, by the feed of the cloth.

Figure 17:
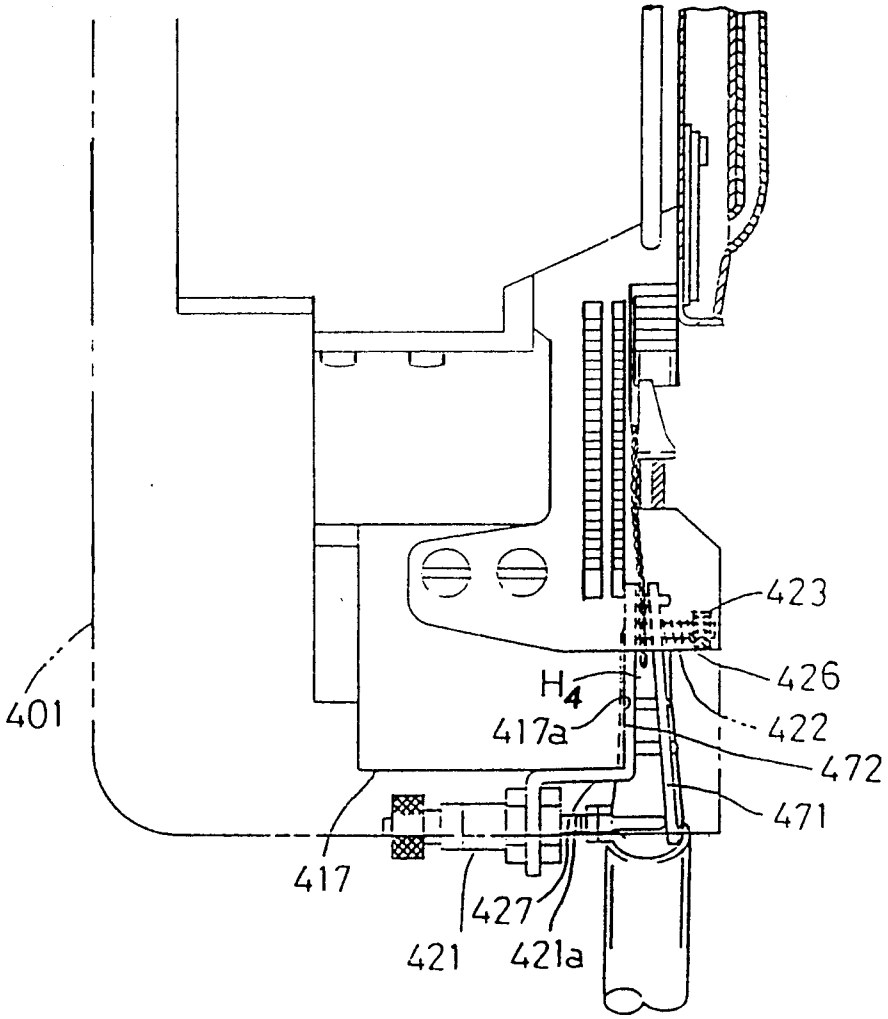
FIG. 17 is a plan view showing a modified example of the device of FIG. 15.

FIG. 17 shows a modified example of the structure for pinching the chaining thread from the chaining thread sew-in device shown in FIG. 15.

In the chaining thread sew-in device shown in FIG. 17, a fixed plate 472, when its longitudinal direction is parallel to the sewing axis X, is mounted on the side 417*a* of a bracket 417 at the back of a cloth plate 401, corresponding to the lower side of the chaining thread insertion hole H. On this fixed plate 472 is integrally formed a mounting piece 427 for air cylinder 421 to be described later.

The pinching plate 471 runs through the bolt 422 set up on the fixed plate 472 behind the chaining thread insertion hole H, and is opposite to the fixed plate 472 beneath the chaining thread insertion hole H. A nut 423 as a spring stopper is set spirally on the bolt 422, and between this nut 423 and the pinching plate 471 a compression spring 426 externally fitted on the bolt 422. is stretched. Therefore, the pinching plate 471 is elastically thrust in the direction to press against the fixed plate 472. An air cylinder 421 is mounted on the mounting piece 427, and the end of the piston rod 421*a* of this air cylinder abuts against one end of the front side of the pinching plate 471 in the contracted state. Therefore, when the piston rod 421*a* is extended by operating the air cylinder 421, the piston rod 421*a* presses one end of the pinching plate 471 by resisting the thrusting force of the compression spring 426, and from this pressing part to the supporting part by the bolt 422, the pinching plate 471 is spaced from the fixed plate 472, which makes it possible to insert the free end of the chaining thread between the pinching plate 471 and the fixed plate 472. Besides, after inserting the free end of the chaining thread between the pinching plate 471 and fixed plate 472, when the piston rod 421*a* is contracted, the free end of the chaining thread is pinched between the pinching plate 471 and the fixed plate.

The constitution for pinching the chaining thread as shown in FIG. 17 provides the same effects as the chaining thread sew-in device as shown in FIG. 15.

POSSIBILITY OF INDUSTRIAL USE

As evident from the description hereabove the chaining thread sew-in device of this invention is useful for treating a chaining thread produced consecutively to seams made on a cloth by an overlock sewing machine, and sewing it into the seams of the next cloth, and it is preferable as a means for automatic operation and in particular for enhancing working efficiency in mass production.

What is claimed is:

1. A chaining thread sew-in-device attached to an overlock machine which forms seams on an edge of a cloth and produces a chaining thread consecutive with said seams at a terminal end of the cloth, said machine having a working face and a needle location and defining a sewing axis, said device comprising:

a suction passage defining a suction hole;

means for sucking the chaining thread into the suction hole provided downstream of the needle location viewed in the direction of cloth movement;

means for cutting the chaining thread near the opening of the suction hole;

air pressure means for moving the free end of the chaining thread cut off from the cloth by said cutting means upstream of the needle location by air pressure from the air pressure means;

pinching means for pinching the transferred chaining thread upstream of the needle location, and sewing this pinched chaining thread into the seams formed in a next cloth; and first and second drive mechanisms, wherein:

the free end of the chaining thread moved upstream of the needle location by said air pressure is inserted by air into an insertion hole opened in the sewing machine working face, and the inserted chaining thread is pinched beneath the sewing machine working face;

a pinching plate moves linearly in a direction which crosses the machine sewing axis to open said insertion hole in the sewing machine working face, and insertion of the free end of the chaining thread into the insertion hole is effected by sucking air from beneath the sewing machine working face;

said pinching means includes said pinching plate forming, with an upper surface thereof, part of the sewing machine working face upstream of the needle location and movable to open the insertion hole for inserting the free end of the chaining thread transferred by said air pressure in said working face, a sub-pinching plate which forms a pinching surface opposite to the pinching plate and is movable to pinch the chaining thread in cooperation with said pinching plate;

said means for cutting including a cutter disposed on a moving trajectory of the chaining thread pinched between the two plates when said sub-pinching plate moves in cooperation with the pinching plate;

said first drive mechanism drives said pinching plate and said second drive mechanism drives said sub-pinching plate;

after inserting the chaining thread into the insertion hole opened into the sewing machine working face by air, the pinching plate is moved by said first drive mechanism to close the insertion hole, and the free end of the chaining thread inserted into the insertion hole is pinched between the pinching plate and the pinching surface forming thereby a pinched end; and after pinching the free end of the chaining thread between the pinching plate and the pinching surface, the sub-pinching plate is driven by said second drive mechanism, and the pinched chaining thread is cut off from the pinched end by crossing said thread with said cutter.

2. A chaining thread sew-in-device attached to an overlock machine which forms seams on an edge of a cloth and produces a chaining thread consecutive with said seams at a terminal end of the cloth, said machine having a working face and a needle location, said device comprising;

a suction passage defining a suction hole;

means for sucking the chaining thread into the suction hole provided downstream of the needle location viewed in the direction of cloth movement;

means for cutting the chaining thread near the opening of the suction hole;

air pressure means for moving the free end of the chaining thread cut off from the cloth by said cutting means upstream of the needle location by air pressure from the air pressure means;

pinching means for pinching the transferred chaining thread upstream of the needle location, and sewing this pinched chaining thread into the seams formed in a next cloth; and first and second drive mechanisms, wherein:

the free end of the chaining thread moved upstream of the needle location by said air pressure is inserted by air into an insertion hole opened in the sewing machine working face, and the inserted chaining thread is pinched beneath the sewing machine working face by sucking air from beneath the sewing machine working face;

said pinching means includes a pinching plate forming, with an upper surface thereof, part of the sewing machine working face upstream of the needle location and movable to open the insertion hole for inserting the free end of the chaining thread transferred by said air pressure in said working face, a sub-pinching plate which forms a pinching surface opposite to the pinching plate and is movable to pinch the chaining thread in cooperation with said pinching plate;

said pinching plate being rotatable along an arc trajectory to open said insertion hole in the sewing machine working face;

said means for cutting including a cutter disposed on a moving trajectory of the chaining thread pinched between the two plates when said sub-pinching plate moves in cooperation with the pinching plate;

said first drive mechanism drives said pinching plate and said second drive mechanism drives said sub-pinching plate;

after inserting the chaining thread into the insertion hole opened into the sewing machine working face by air, the pinching plate is moved by said first drive mechanism to close the insertion hole, and the free end of the chaining thread inserted into the insertion hole is pinched between the pinching plate and the pinching surface forming thereby a pinched end; and after pinching the free end of the chaining thread between the pinching plate and the pinching surface, the sub-pinching plate is driven by said second drive mechanism, and the pinched chaining thread is cut off from the pinched end by crossing said thread with said cutter.

3. A chaining thread sew-in-device attached to an overlock machine which forms seams on an edge of a cloth and produces a chaining thread consecutive with said seams at a terminal end of the cloth, said machine having a working face and a needle location, said device comprising:

a suction passage defining a suction hole;

means for sucking the chaining thread into the suction hole provided downstream of the needle location viewed in the direction of cloth movement;

means for cutting the chaining thread near the opening of the suction hole;

air pressure means for moving the free end of the chaining thread cut off from the cloth by said cutting means upstream of the needle location by air pressure from the air pressure means;

pinching means for pinching the transferred chaining thread upstream of the needle location, and sewing this pinched chaining thread into the seams formed in a next cloth;

a cloth plate forming the working face of the sewing machine, said cloth plate having a chaining thread insertion hole formed therein;

a fixed plate fixed beneath said chaining thread insertion hole;

a drive mechanism; and chaining thread insertion means, wherein:

the free end of the chaining thread moved upstream of the needle location by said air pressure is inserted by air into said insertion hole opened in the sewing machine working face, and the inserted chaining thread is pinched beneath the sewing machine working face;

said pinching means includes a pinching plate which contacts with and separates from said fixed plate beneath said chaining thread insertion hole;

said chaining thread insertion means inserting the chaining thread into said chaining thread insertion hole and between the mutually spaced fixed plate and pinching plate by air; and said pinching plate is driven by said drive mechanism to be spaced from said fixed plate, the chaining thread being inserted between the pinching plate and the fixed plate by the chaining thread insertion means, and the pinching plate is pressed tight against the fixed plate, so that the free end of the chaining thread is pinched between these plates.

4. The chaining thread sew-in-device of claim 3, wherein by actuating said drive mechanism said chaining thread insertion means blows air into said insertion hole from above the sewing machine working face to insert the free end of the chaining thread between the mutually spaced fixed plate and pinching plate.

5. The chaining thread sew-in-device of claim 3, wherein by actuating said drive mechanism, said chaining thread insertion means sucks air from beneath said fixed plate and pinching plate to insert the free end of the chaining thread between the mutually spaced fixed plate and pinching plate.

6. A chaining thread sew-in-device attached to an overlock machine which forms seams on an edge of a cloth and produces a chaining thread consecutive with said seams at a terminal end of the cloth, said machine having a working face and a needle location, said device comprising: a suction passage defining a suction hole; means for sucking the chaining thread into the suction hole provided downstream of the needle location viewed in the direction of cloth movement; means for cutting the chaining thread near the opening of the suction hole; air pressure means for moving the free end of the chaining thread cut off from the cloth by said cutting means upstream of the needle location by air pressure from the air pressure means; a first drive mechanism; a second drive mechanism; and pinching means for pinching the transferred chaining thread upstream of the needle location, and sewing this pinched chaining thread into the seams formed in a next cloth, wherein:

the free end of the chaining thread moved upstream of the needle location by said air pressure is inserted by air into an insertion hole opened in the sewing machine working face, and the inserted chaining thread is pinched beneath the sewing machine working face;

said pinching means includes a pinching plate forming, with an upper surface thereof, part of the sewing machine working face upstream of the needle location and movable to open the insertion hole for inserting the free end of the chaining thread transferred by said air pressure in said working face;

said pinching plate being rotatable along an arc trajectory to open said insertion hole in the sewing machine working face;

said first drive mechanism driving said pinching plate;

said pinching means further includes a sub-pinching plate which forms a pinching surface opposite to the pinching plate and is movable to pinch the chaining thread in cooperation with said pinching plate;

said second drive mechanism driving said sub-pinching plate;

said means for cutting including a cutter disposed on a moving trajectory of the chaining thread pinched between the two plates when said sub-pinching plate moves in cooperation with the pinching plate;

after inserting the chaining thread into the insertion hole opened in the sewing machine working face by air, the pinching plate is moved by said first drive mechanism to close the insertion hole, and the free end of the chaining thread inserted into the insertion hole is pinched between the pinching plate and said pinching surface opposite to the pinching plate when forming the insertion hole; and after pinching the free end of said chaining thread between said pinching plate and sub-pinching plate, the sub-pinching plate is driven by said second drive mechanism, and the pinched chaining thread is cut off from the pinched end by crossing said thread with said cutter.

7. The chaining thread sew-in-device of claim 6, further wherein: insertion of the free end of the chaining thread into the insertion hole is effected by blowing air into the insertion hole from above the sewing machine working face.

8. A chaining thread sew-in-device attached to an overlock machine which forms seams on an edge of a cloth and produces a chaining thread consecutive with said seams at a terminal end of the cloth, said machine having a working face and a needle location, said device comprising: a suction passage defining a suction hole; means for sucking the chaining thread into the suction hole provided downstream of the needle location viewed in the direction of cloth movement; means for cutting the chaining thread near the opening of the suction hole; air pressure means for moving the free end of the chaining thread cutoff from the cloth by said cutting means upstream of the needle location by air pressure from the air pressure means; a drive mechanism; and pinching means for pinching the transferred chaining thread upstream of the needle location, and sewing this pinched chaining thread into the seams formed in a next cloth, wherein:

the free end of the chaining thread moved upstream of the needle location by said air pressure is inserted by air into an insertion hole opened in the sewing machine working face, and the inserted chaining thread is pinched beneath the sewing machine working face;

said pinching means includes a pinching plate forming, with an upper surface thereof, part of the sewing machine working face upstream of the needle location and movable to open the insertion hole for inserting the free end of the chaining thread transferred by said air pressure in said working face;

said pinching plate being rotatable along an arc trajectory to open said insertion hole in the sewing machine working face;

said drive mechanism driving said pinching plate;

after inserting the chaining thread into the insertion hole opened in the sewing machine working face by air, the pinching plate is moved by said drive mechanism to close the insertion hole, and the free end of the chaining thread inserted into the insertion hole is pinched between the pinching plate and a pinching surface opposite to the pinching plate when forming the insertion hole; and insertion of the free end of the chaining thread into the insertion hole is effected by sucking air from beneath the sewing machine working face.

* * * * *

UNITED STATES PATENT AND TRADEMARK OFFICE

CERTIFICATE OF CORRECTION

PATENT NO. : 5,119,747

DATED : June 9, 1992

INVENTOR(S) : Yukio Nishiura et al

It is certified that error appears in the above-identified patent and that said Letters Patent is hereby corrected as shown below:

Claim 1, column 22, line 17, "sewing" should be inserted between "the" and "machine".

Claim 8, column 26, line 8, a blank space should be inserted between "cut" and "off".

Signed and Sealed this

Twenty-fourth Day of August, 1993

*Attest:*

*Attesting Officer*

BRUCE LEHMAN

*Commissioner of Patents and Trademarks*